United States Patent [19]

Asano et al.

[11] Patent Number: 5,041,366

[45] Date of Patent: Aug. 20, 1991

[54] SILVER HALIDE PHOTOGRAPHIC MATERIAL

[75] Inventors: Satomi Asano; Hiroshi Okusa; Nobuaki Kagawa; Hirofumi Ohtani; Syoji Matsuzaka, all of Tokyo, Japan

[73] Assignee: Konica Corporation, Tokyo, Japan

[21] Appl. No.: 429,648

[22] Filed: Oct. 31, 1989

[30] Foreign Application Priority Data

| | | | |
|---|---|---|---|
| Nov. 1, 1988 | [JP] | Japan | 63-278204 |
| Dec. 15, 1988 | [JP] | Japan | 63-318070 |
| Dec. 15, 1988 | [JP] | Japan | 64-318071 |

[51] Int. Cl.[5] ..... G03C 1/02

[52] U.S. Cl. ..... 430/567; 430/574

[58] Field of Search ..... 430/574, 567

[56] References Cited

U.S. PATENT DOCUMENTS

| | | | |
|---|---|---|---|
| 4,571,380 | 2/1986 | Noguchi et al. | 430/574 |
| 4,594,317 | 6/1986 | Sasaki et al. | 430/574 |
| 4,701,405 | 10/1987 | Takiguchi et al. | 430/574 |

*Primary Examiner*—Charles L. Bowers, Jr.
*Assistant Examiner*—Thomas R. Neville
*Attorney, Agent, or Firm*—Finnegan, Henderson, Farabow, Garrett, and Dunner

[57] ABSTRACT

A silver halide photographic material in which at least one silver halide emulsion layer coated onto a base support has been subjected to supersensitization by the combination of at least one symmetrical carbocyanine dye having two symmetrical heterocyclic structures, at least one other symmetrical carbocyanine dye having two symmetrical heterocyclic structures, and at least one asymmetrical carbocyanine dye having either one of the two heterocyclic structures in the first symmetrical carbocyanine dye and either one of the two heterocyclic structures in the second symmetrical carbocyanine dye. This photographic material has high spectral sensitivity and good storage stability since it is resistant to desensitization due to desorption of spectral sensitizers from silver halides.

19 Claims, No Drawings

SILVER HALIDE PHOTOGRAPHIC MATERIAL

BACKGROUND OF THE INVENTION

The present invention relates to a spectrally sensitized silver halide photographic material. More particularly, the present invention relates to a silver halide photographic material having high spectral sensitivity and improved storage stability.

Various compounds have conventionally been used in combination to provide silver halide photographic materials with improved spectral sensitivity in the green range. Exemplary combinations include the use of two kinds of oxacarbocyanine compounds as described in JP-B-44-32753 (the term "JP-B"- as used herein means an "examined Japanese patent publication") and JP-A-52-23931 (the term "JP-A" as used herein means an "unexamined published Japanese patent application"), oxacarbocyanine combined with benzimidazolocarbocyanine as described in JP-A-59-16646, and oxacarbocyanine in combination with oxathiacarbocyanine as described in JP-A-60-42750 and JP-A-63-167348. Two kinds of thiacarbocyanine compounds have also been used to provide improved spectral sensitivity in the red range as described in JP-B-43-4933, JP-B-47-8741 and JP-B-51-5781.

However, these compounds often cause desensitization in multi-layered silver halide photographic materials. It is not completely clear why this problem which seldom occurs in single layered structures should take place in multi-layered structures but it is speculated that the multi-layered structure would cause desorption of adsorbed dyes or rearrangement of the same.

With a view to solving this problem, various methods have been tried to enhance the adsorption of dyes such as by changing the halide composition of silver halide emulsions or the crystal habit of silver halide grains or by adding halogens. However, the effectiveness of these methods has been limited by the fact that the change in the conditions for the formation of silver halide crystals inevitably results in variations in the ripening conditions and other factors, thus causing adverse effects in photographic performance characteristics such as a balance between one emulsion layer and the other emulsion layers or the keeping quality of photographic materials.

It has therefore been desired to develop a method of spectrally sensitizing silver halide photographic materials that is free from the defects described above and which is capable of providing them with enhanced sensitivity to light.

SUMMARY OF THE INVENTION

An object, therefore, of the present invention is to provide a silver halide photographic material that has enhanced spectral sensitivity to light, in particular green or red light.

Another object of the present invention is to provide a silver halide photographic material that will experience a very small degree of desensitization due to desorption of dyes from silver halides.

A further object of the present invention is to provide a silver halide photographic material having improved storage stability.

As a result of various studies conducted in order to attain these objects, the present inventors found that photographic materials that would not experience desensitization due to desorption of dyes and which had improved storage stability could be obtained by performing sensitization with a specified combination consisting of two different symmetrical dyes and one asymmetrical dye having partial structures common to, one of those in said symmetrical dyes.

The mechanism for the supersensitizing effect of the combination of these dyes is yet to be unravelled but a plausible explanation would be that a strong intermolecular force acts between the symmetrical dyes and the asymmetrical dye, thereby preventing dye desorption while improving the efficiency of spectral sensitization.

The present invention has been accomplished on the basis of these findings.

The objects of the present invention can generally be attained by a silver halide photographic material in which at least one silver halide emulsion layer coated onto a base support has been subjected to supersensitization by the combination of at least one symmetrical carbocyanine dye having two symmetrical heterocyclic structures as represented by the following general formula (I), at least one symmetrical carbocyanine dye also having two symmetrical heterocyclic structures as represented by the following general formula (II), and at least one asymmetrical carbocyanine dye represented by the following general formula (III) which has either one of the two heterocyclic structures shown in the general formula (I) and either one of the two heterocyclic structures shown in the general formula (II):

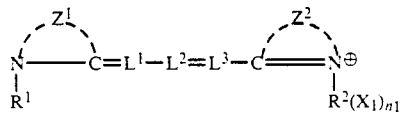
(I)

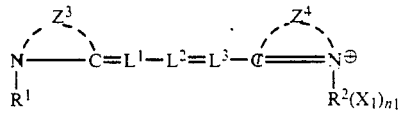
(II)

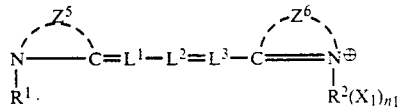
(III)

where $Z^1$ and $Z^2$ each represents the nonmetallic atomic group necessary to form the same benzoxazole ring nucleus, benzimidazole ring nucleus, naphtho[2,3-α]oxazole ring nucleus or benzothiazole ring nucleus; $Z^3$ and $Z^4$ each represents the nonmetallic atomic group necessary to form the same naphthoxazole ring nucleus, naphthoimidazole ring nucleus or naphthothiazole ring nucleus when $Z^1$ and $Z^2$ each represents the nonmetallic atomic group necessary to form the same benzoxazole ring nucleus, benzimidazole ring nucleus or benzothiazole ring nucleus, and $Z^3$ and $Z^4$ each represents the nonmetallic atomic group necessary to form the same naphtho[1,2-α]oxazole ring nucleus or naphtho[2,1-α]oxazole ring nucleus when $Z^1$ and $Z^2$ each represents the nonmetallic atomic group necessary to form the same naphtho [2, 3- α]oxazole ring nucleus; $Z^5$ has the same as meaning as defined for $Z^1$ or $Z^2$ or it represents $Z^1$ or $Z^2$ that has a substituent defined by a sterimol parameter ($L/B_1$) of not greater than 2.2; $Z^6$ has the same meaning as defined for $Z^3$ or $Z^4$ or it represents $Z^3$ or $Z^4$ that has a substituent defined by a sterimol parameter ($L/B_1$) of not greater than 2.2; $R^1$ and $R^2$ which may be the same or different each represents an alkyl or a substituted alkyl group; $L^1$, $L^2$ and $L^3$ each represents a methine or a substituted methine group; $X_1$ is a counter ion residue, preferably an anion; and $n_1$ is 0 or 1.

The optional substituent for $Z^5$ or $Z^6$ in the general formula (III) has such values of L and $B_1$ that S as defined by $L/B_1$ will have a value of 2.2 or below The symbols L and $B_1$ are those used to define the sterimol parameter in A. Verloop, W. Hoogenstraagen and J. Tipker, "Drug Design", Vol. 7, ed. by E. J. Ariëns, New York, 1976, pp. 180–185 and are expressed in angstroms. The values of S as calculated for various substituents are listed in the following table.

| Substituent | S | L (Å) | $B_1$ (Å) |
|---|---|---|---|
| F | 1.96 | 2.65 | 1.35 |
| Cl | 1.96 | 3.52 | 1.80 |
| Br | 1.96 | 3.83 | 195 |
| I | 1.97 | 4.23 | 2.15 |
| $CH_3$ | 1.97 | 3.00 | 1.52 |
| $CH_2F$ | 2.17 | 3.30 | 1.52 |
| $CF_3$ | 1.67 | 3.30 | 1.98 |
| $CCl_3$ | 1.45 | 3.89 | 2.63 |
| OH | 2.03 | 2.74 | 1.35 |
| SH | 2.04 | 3.47 | 1.70 |
| $NH_2$ | 1.95 | 2.93 | 1.50 |
| $SO_2CH_3$ | 2.07 | 4.37 | 2.11 |
| $SO_2NH_2$ | 1.81 | 3.82 | 2.11 |
| $COCH_3$ | 2.14 | 4.06 | 1.90 |

The term "symmetrical carbocyanine dye" as used herein means at least a dye having the same heterocyclic nucleus on the right and left sides of its structural formula and is should be understood that those dyes having different substituents on the two heterocyclic nuclei are also included within the definition of this term.

Examples of the optionally substituted alkyl group represented by each of $R^1$ and $R^2$ include: unsubstituted alkyl groups having 1–18, preferably 1–7, more preferably 1–4, carbon atoms (e.g. methyl, ethyl, propyl, isopropyl, butyl, isobutyl, hexyl, octyl, dodecyl and octadecyl); substituted alkyl groups such as aralkyl groups (e.g. benzyl and 2-phenylethyl), hydroxyalkyl groups (e.g. 2-hydroxyethyl and 3-hydroxypropyl), carboxyalkyl groups (e.g. 2-carboxyethyl, 3-carboxypropyl, carboxyethyl, 3-carboxypropyl, 4-carboxybutyl and carboxymethyl), alkoxyalkyl groups [e.g. 2-methoxyethyl and 2-(2-methoxyethoxy)ethyl], sulfoalkyl groups (e.g. 2-sulfoethyl, 3-sulfopropyl, 3-sulfobutyl, 4-sulfobutyl, 2-(3-sulfopropoxy)ethyl, 2-hydroxy-3-sulfopropyl and 3-sulfopropoxyethoxyethyl), sulfatoalkyl groups (e.g. 3-sulfatopropyl and 4-sulfatobutyl), hetero ring substituted alkyl groups (e.g. 2-pyrrolidin-2-on-1-yl-ethyl, tetrahydrofurfuryl and 2-morpholinoethyl), 2-acetoxyethyl group, carbomethoxymethyl group, 2-methanesulfonylaminoethyl group and allyl group; aryl groups (e.g. phenyl and 2-naphthyl); substituted aryl groups (e.g. 4-carboxyphenyl, 4-sulfophenyl, 3-chlorophenyl and 3-methylphenyl); and heterocyclic groups (e.g. 2-pyridyl and 2-thiazolyl).

In the general formulas (I), (II) and (III), $L^1$, $L^2$ and $L^3$ each represents a methine or a substituted methine group, and exemplary substituents include alkyl groups (e.g. methyl and ethyl), aryl groups (e.g. phenyl), aralkyl groups (e.g. benzyl), halogen atoms (e.g. chlorine and bromine), and alkoxy groups (e.g. methoxy and ethoxy). If desired, the substituents in the methine chain may combine with either themselves or $R^1$ or $R^2$ to form a 4-, 5- or 6-membered ring.

In the general formulas (I), (II) and (III), $X_1$ represents a counter ion residue, preferably an anion and $n_1$ is 0 or 1.

In the present invention, dyes represented by the general formulas (I), (II) and (III) may preferably be used in the following combinations (A) to (C).

(A) the combination of a dye of the general formula (I) where $Z^1$ and $Z^2$ each represents the nonmetallic atomic group necessary to form the same benzoxazole ring nucleus or benzimidazole ring nucleus, a dye of the general formula (II) where $Z^3$ and $Z^4$ each represents the nonmetallic atomic group necessary to form the same naphthoxazole ring nucleus or naphthoimidazole ring nucleus, and a corresponding dye of the general formula (III);

(B) the combination of a dye of the general formula (I) where $Z^1$ and $Z^2$ each represents the nonmetallic atomic group necessary to form the same naphtho[2,3-α]oxazole ring nucleus, a dye of the general formula (II) where $Z^3$ and $Z^4$ each represents the nonmetallic atomic group necessary to form the same naphtho[1,2-α]oxazole ring nucleus or naphtho[1,2-α]oxazole ring nucleus, and a corresponding dye of the general formula (III); and (C) a dye of the general formula (I) where $Z^1$ and $Z^2$ each represents the nonmetallic atomic group necessary to form the same benzothiazole ring nucleus, a dye of the general formula (II) where $Z^3$ and $Z^4$ each represents the nonmetallic atomic group necessary to form the same naphthothiazole ring nucleus, and a corresponding dye of the general formula (III).

The dyes represented by the general formulas (I), (II) and (III) and which are to be used in the present invention are described below in detail. The dyes represented by the general formula (I) preferably include a symmetrical oxacarbocyanine of the general formula (I-I), a symmetrical benzimidazolocarbocyanine of the general formula (I-II), a symmetrical oxacarbocyanine of the general formula (I-III), and a symmetrical thiacarbocyanine of the general formula (I-IV). The general formulas (I-I) to (I-IV) are set forth below:

(I-I)

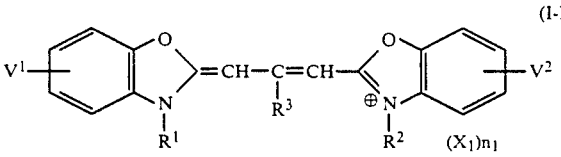

where $V^1$ and $V^2$ which may be the same or different preferably represent a hydrogen atom, a halogen atom (e.g. chlorine, bromine or fluorine), an alkyl group having up to 6 carbon atoms (e.g. methyl, ethyl, propyl, butyl or cyclohexyl), an aryl group (e.g. phenyl), an alkoxy group having up to 4 carbon atoms (e.g. methoxy, ethoxy or butoxy), an aryloxy group (e.g. phenoxy), an acyl group having up to 6 carbon atoms (e.g. acetyl, propionyl or benzoyl), an alkoxycarbonyl group having up to 8 carbon atoms (e.g. methoxycarbonyl, ethoxycarbonyl, phenoxycarbonyl or benzyloxycarbonyl), a hydroxy group, a cyano group or a trifluoromethyl group; $R^3$ represents an alkyl group having up to 2 carbon atoms (e.g. methyl or ethyl); and $R^1$, $R^2$ and $(X_1)_{n1}$ each has the same meaning as defined in the general formula (I);

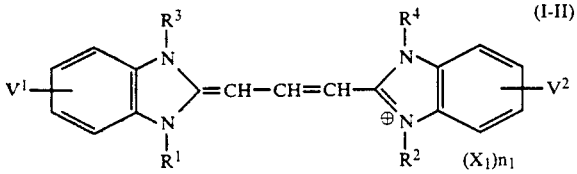

(I-II)

where $V^1$ and $V^2$ which may be the same or different preferably represent a hydrogen atom, a halogen atom (e.g. chlorine, bromine or fluorine), an alkyl group having up to 6 carbon atoms (e.g. methyl, ethyl, propyl, butyl or cyclohexyl), an aryl group (e.g. phenyl), an alkoxy group having up to 4 carbon atoms (e.g. methoxy, ethoxy or butoxy), an aryloxy group (e.g. phenoxy), an acyl group having up to 6 carbon atoms (e.g. acetyl, propionyl or benzoyl), an acyloxy group having up to 3 carbon atoms (e.g. acetoxy), an alkoxycarbonyl group having up to 8 carbon atoms (e.g. methoxycarbonyl, ethoxycarbonyl, phenoxycarbonyl or benzyloxycarbonyl), a carbamoyl group having up to 8 carbon atoms (e.g. carbamoyl, NH-dimethylcarbamoyl, morpholinocarbonyl and piperidinocarbonyl), a sulfamoyl group having up to 8 carbon atoms (e.g. sulfamoyl, NN-dimethyl-sulfamoyl, morpholisulfonyl or piperidinosulfonyl), a hydroxy group, a cyano group or a trifluoromethyl group; $R^3$ and $R^4$ preferably represent independently a substituted or unsubstituted alkyl group or an aryl group and the unsubstituted alkyl group may be an alkyl group having up to 6 carbon atoms (e.g. methyl, ethyl, propyl, butyl, pentyl or hexyl), and the substituted alkyl group may be the same as the alkyl group mentioned above, except that it has a substituent such as a halogen atom (e.g. chlorine, bromine or fluorine), a hydroxy group, a carboxy group, a phenyl group, a cyano group, an alkoxy group having up to 4 carbon atoms, a carbamoyl group or a sulfamoyl group; and $R^1$, $R^2$ and $(X_1)_{n1}$ each has the same meaning as defined in the general formula (I);

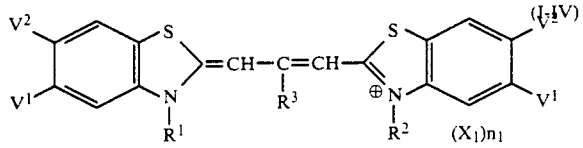

(I-IV)

where $V^1$ and $V^2$ which may be the same or different preferably represent a hydrogen atom, a halogen atom (e.g. chlorine, bromine or fluorine), an alkyl group having up to 6 carbon atoms (e.g. methyl, ethyl, propyl, butyl or cyclohexyl), an aryl group (e.g. phenyl), an alkoxy group having up to 4 carbon atoms (e.g. emthoxy, ethoxy or butoxy), an aryloxy group (e.g. phenoxy), an acyl group having up to 7 carbon atoms (e.g. acetyl, propionyl or benzoyl), an alkoxycarbonyl group having up to 8 carbon atoms (e.g. methoxycarbonyl, ethoxycarbonyl, phenoxycarbonyl or benzyloxycarbonyl), a hydroxy group, a cyano group or a trifluoromethyl group; $R^3$ represents an alkyl group having up to 2 carbon atoms (e.g. methyl or ethyl); and $R^1$, $R^2$ and $(X_1)_{n1}$ each has the same meaning as defined in the general formula (I).

The dye represented by the general formula (II) is also of a symmetrical type like the dye of the general formula (I). Preferably, it is a symmetrical naphthoxacarbocyanine or naphthoimidazolocarbocyanine having naphtho rings condensed together as hetero rings, a symmetrical oxacarbocyanine having the naphtho[1,2-d]oxazole ring nucleus or naphtho[2,1-d]oxazole ring nucleus as a hetero ring, or a symmetrical naphtho[1,2-d]thiacarbocyanine, naphtho[2,1-d]thiacarbocyanine or naphtho[2,3-d]thiacarbocyanine having naphtho rings condensed together as hetero rings.

In the present invention, dyes represented by the general formula (I) and (II) may preferably be used in the combination of a dye of the general formual (I) where $Z^1$ and $Z^2$ each represents the nonmetallic atomic group necessary to form the same benzoxazole ring

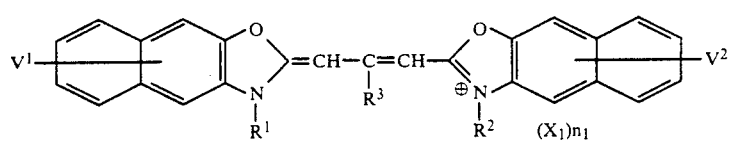

(I-III)

where $V^1$ and $V^2$ which may be the same or different preferably represent a hydrogen atom, a halogen atom (e.g. chlorine, bromine or fluorine), an alkyl group having up to 6 carbon atoms (e.g. methyl, ethyl, propyl, butyl or cyclohexyl), an aryl group (e.g. phenyl group), an alkoxy group having up to 4 carbon atoms (e.g. methoxy, ethoxy or butoxy), an aryloxy group (e.g. phenoxy), an acyl group having up to 7 carbon atoms (e.g. acetyl, propionyl or benzoyl), an alkoxycarbonyl group having up to 8 carbon atoms (e.g. methoxycarbonyl, ethoxycarbonyl,l phenoxycarbonyl or benzyloxycarbonyl), a hydroxy group, a cyano group or a trifluoromethyl group; $R^3$ represents an alkyl group having up to 2 carbon atoms (e.g. emthyl or ethyl); and $R^1$, $R^2$ and $(X_1)_{n1}$ each has the same meaning as defined in the general formula (I);

nucleus, and a dye of the general formula (II) where $Z^3$ and $Z^4$ each represents the nonmetallic atomic group necessary to form the same naphthoxazole ring nucleus.

In contrast to the dyes of the general formula (I) and (II) which are symmetrical carbocyanine compounds, the dye represented by the general formula (III) is asymmetrical oxacarbocyanine, benzimidazolocarbocyanine, oxaimidazolocarbocyanine or thiacarbocyanine.

Substituents $R^1$ and $R^2$, methine chains $L^1$–$L^3$, and counter ion $(X_1)_{n1}$ in the general formulas (II) and (III) have the same meanings as defined in the general formula (I).

Typical examples of the dye compounds represented by the general formulas (I)–(III) which can be used in the present invention are listed below but it should be understood that the present invention is by no means limited to these examples alone.

i) Compound of the general formula (I)

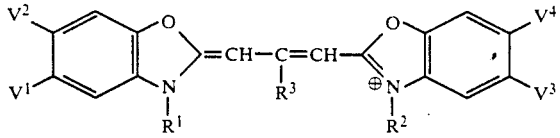

| Dye No. | $V^1$ | $V^2$ | $R^1$ | $R^3$ | $R^2$ | $V^3$ | $V^4$ |
|---|---|---|---|---|---|---|---|
| I-1 | H | H | $-(CH_2)_3-SO_3K$ | $-C_2H_5$ | $-(CH_2)_3-SO_3K^{\ominus}$ | H | H |
| I-2 | 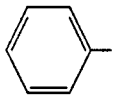 | H | $-(CH_2)_3-SO_3H.N(C_2H_5)_3$ | $-C_2H_5$ | $-(CH_2)_3-SO_3K^{\ominus}$ | 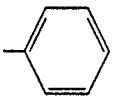 | H |
| I-3 | $-Cl$ | H | $-(CH_2)_2-SO_3Na$ | $-C_2H_5$ | $-(CH_2)_2-SO_3^{\ominus}$ | $-Cl$ | H |
| I-4 | $-CH_3$ | H | $-C_2H_5$ | $-C_2H_5$ | $-(CH_2)_4-SO_3^{\ominus}$ | $-CH_3$ | H |
| I-5 | $-Cl$ | $-CH_3$ | $-(CH_2)_4-SO_3HN$ 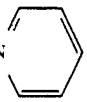 | $-C_2H_5$ | $-(CH_2)_4-SO_3^{\ominus}$ | $-Cl$ | $-CH_3$ |
| I-6 | $-CH_2CN$ | H | $-(CH_2)_3-SO_3Na$ | $-C_2H_5$ | $-(CH_2)_3-SO_3^{\ominus}$ | $-CH_2CN$ | H |
| I-7 | $-OCH_3$ | H | $-(CH_2)_3-SO_3Na$ | $-C_2H_5$ | $-(CH_2)_2-SO_3^{\ominus}$ | $-OCH_3$ | H |
| I-8 | H | $-CH_3$ | $-(CH_2)_3-SO_3HN(C_2H_5)_3$ | $-C_2H_5$ | $-(CH_2)_3-SO_3^{\ominus}$ | $-CH_3$ | H |
| I-9 | $-OC_2H_5$ | H | $-(CH_2)_4-SO_3Na$ | $-C_2H_5$ | $-(CH_2)_4-SO_3^{\ominus}$ | $-OC_2H_5$ | H |
| I-10 | $-CH_2-$ 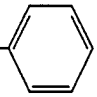 | H | $-CH_2CH_2OH$ | $-C_2H_5$ | $-(CH_2)_2-SO_3^{\ominus}$ | $-CH_2-$ 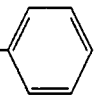 | H |
| I-11 | $-OC_4H_9$ | H | $-C_2H_5$ | $-C_2H_5$ | $-(CH_2)_3-SO_3^{\ominus}$ | $-OC_4H_9$ | H |
| I-12 | $-OH$ | H | $-C_2H_5$ | $-C_2H_5$ | $-(CH_2)_4-SO_3^{\ominus}$ | $-OH$ | H |

-continued i) Compound of the general formula (I)

| No. | $V^1$ | $V^2$ | $R^1$ | $R^3$ | $R^2$ | $R^4$ | $V^3$ | $V^4$ |
|---|---|---|---|---|---|---|---|---|
| | 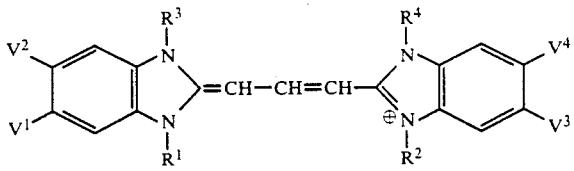 | | | | | | | |
| I-13 | $-Cl$ | H | $-(CH_2)_3-SO_3Na$ | $-C_2H_5$ | $-(CH_2)_3-SO_3^{\ominus}$ | $-C_2H_5$ | $-Cl$ | H |
| I-14 | $-COOC_2H_5$ | $-Cl$ | $-CH_2-C_6H_4-SO_3Na$ | $-C_2H_5$ | $-CH_2-C_6H_4-SO_3^{\ominus}$ | $-C_2H_5$ | $-COOC_2H_5$ | $-Cl$ |
| I-15 | $-Cl$ | $-Cl$ | $-(CH_2)_4-SO_3HN-C_6H_5$ | $-C_2H_5$ | $-(CH_2)_4-SO_3^{\ominus}$ | $-C_2H_5$ | $-Cl$ | $-Cl$ |
| I-16 | $-CN$ | $-Cl$ | $-(CH_2)_3-SO_3Na$ | $-C_2H_5$ | $-(CH_2)_3-SO_3^{\ominus}$ | $-C_2H_5$ | $-CN$ | $-Cl$ |
| I-17 | $-CF_3$ | H | $-(CH_2)_3-SO_3K$ | $-C_2H_5$ | $-(CH_2)_3-SO_3^{\ominus}$ | $-C_2H_5$ | $-CF_3$ | $-H$ |
| I-18 | $-CN$ | H | $-(CH_2)_4-SO_3HN(C_2H_5)_3$ | $-C_2H_5$ | $-(CH_2)_4-SO_3^{\ominus}$ | $-C_2H_5$ | $-CN$ | $-H$ |
| I-19 | $-CF_3$ | H | $-(CH_2)_3-SO_3Na$ | $-C_2H_5$ | $-(CH_2)_3-SO_3^{\ominus}$ | $-C_2H_5$ | $-CF_3$ | $-Cl$ |
| I-20 | $-SO_2CH_3$ | H | $-(CH_2)_2-SO_3Na$ | $-C_2H_5$ | $-(CH_2)_3-SO_3^{\ominus}$ | $-C_2H_5$ | $-SO_2CH_3$ | H |
| I-21 | 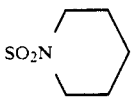 | H | $-C_2H_5$ | $-C_2H_5$ | $-C_2H_5$ | $-C_2H_5$ | 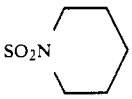 | H |
| | 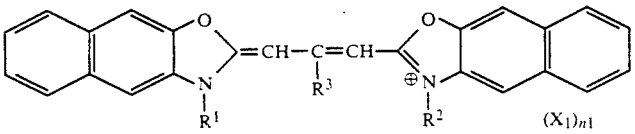 | | | | | | | |
| I-22 | | | $-(CH_2)_3-SO_3K$ | $-C_2H_5$ | $-(CH_2)_3-SO_3^{\ominus}$ | | | |

-continued

| i) Compound of the general formula (I) | | | | | |
|---|---|---|---|---|---|
| I-23 | | | | $-C_2H_5$ | 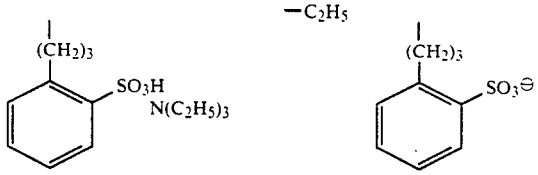 |
| I-24 | | | $-CH_2COOH$ | $-C_2H_5$ | $-(CH_2)_4-SO_3^{\ominus}$ |
| I-25 | | | 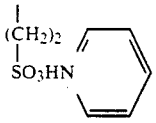 | $-C_2H_5$ | $-(CH_2)_2-SO_3^{\ominus}$ |
| I-26 | | | $-C_2H_5$ | $-C_2H_5$ | $-(CH_2)_3-SO_3^{\ominus}$ |
| I-27 | | | $-C_2H_5$ | $-C_2H_5$ | $-C_2H_5$ |
| I-28 | | | 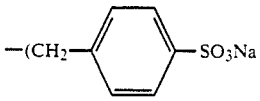 | $-C_2H_5$ | $-(CH_2)SO_3^{\ominus}$ |
| I-29 | | | $-CH_2CH(SO_3Li)-CH_3$ | $-C_2H_5$ | $-CH_2CH(SO_3^{\ominus})-CH_3$ |
| | | | 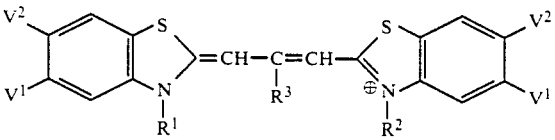 | | |
| I-30 | H | H | $-(CH_2)_3-SO_3K$ | $-CH_3$ | $-(CH_2)_3-SO_3^{\ominus}$ |
| I-31 | $-Cl$ | H | $-(CH_2)_3-SO_3H.N(C_2H_5)_3$ | $-C_2H_5$ | $-(CH_2)_3-SO_3^{\ominus}$ |
| I-32 | $-Cl$ | H | $-(CH_2)_3-SO_3Na$ | $-C_2H_5$ | $-(CH_2)_3-SO_3^{\ominus}$ |
| I-33 | $-Cl$ | $-CH_3$ | $-C_2H_5$ | $-C_2H_5$ | $-(CH_2)_4-SO_3^{\ominus}$ |
| I-34 | $-Cl$ | $-CH_3$ | 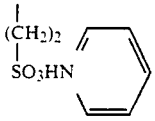 | $-C_2H_5$ | $-(CH_2)_2-SO_3^{\ominus}$ |

-continued i) Compound of the general formula (I)

| | | | | | |
|---|---|---|---|---|---|
| I-35 | $-CH_2CN$ | H | $-(CH_2)_3-SO_3Na$ | $-C_2H_5$ | $-(CH_2)_3-SO_3^{\ominus}$ |
| I-36 | $-OCH_3$ | H | $-(CH_2)_3-SO_3Na$ | $-C_2H_5$ | $-(CH_2)_2-SO_3^{\ominus}$ |
| I-37 | H | $-CH_3$ | $-(CH_2)_3-SO_3HN(C_2H_5)_3$ | $-C_2H_5$ | $-(CH_2)_3-SO_3^{\ominus}$ |
| I-38 | $-OC_2H_5$ | H | $-(CH_2)_4-SO_3Na$ | $-C_2H_5$ | $-(CH_2)_4-SO_3^{\ominus}$ |
| I-39 | $-CH_2-C_6H_5$ | H | $-CH_2CH_2OH$ | $-C_2H_5$ | $-(CH_2)_2-SO_3^{\ominus}$ |
| I-40 | $-COOC_2H_5$ | H | $-C_2H_5$ | $-C_2H_5$ | $-(CH_2)_3-SO_3^{\ominus}$ |
| I-41 | $-OH$ | H | $-C_2H_5$ | $-C_2H_5$ | $-(CH_2)_4-SO_3^{\ominus}$ |
| I-42 | $-Cl$ | H | $-CH_2COOH$ | $-C_2H_5$ | $-(CH_2)_3-SO_3^{\ominus}$ |

(ii) Compound of the general formula (II)

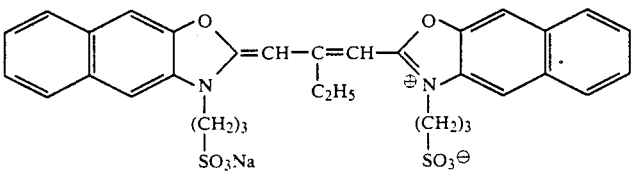

II-1

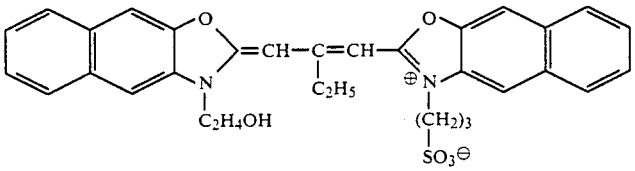

II-2

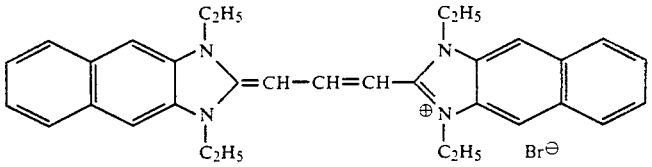

II-3

-continued (ii) Compound of the general formula (II)

II-4

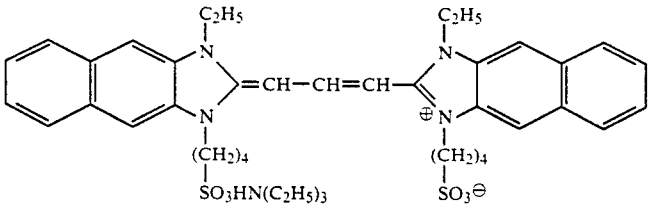

II-5

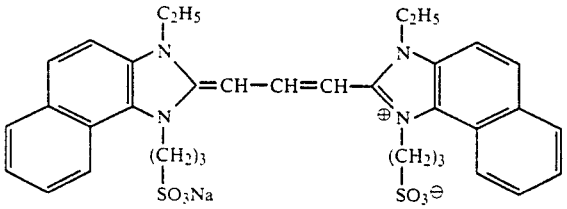

II-6

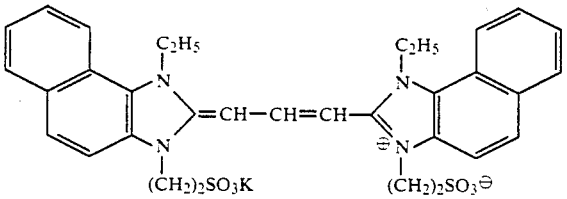

-continued

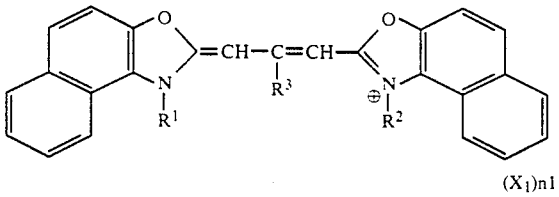

| Dye No. | $R^1$ | $R^3$ | $R^2$ |
|---|---|---|---|
| II-7 | $(CH_2)_3SO_3K$ | $-C_2H_5$ | $(CH_2)_3SO_3^{\ominus}$ |
| II-8 | $CH_3$ | $-C_2H_5$ | $(CH_2)_3SO_3^{\ominus}$ |
| II-9 | $C_2H_5$ | $-CH_3$ | $(CH_2)_3SO_3^{\ominus}$ |
| II-10 | $-C_2H_5$ | $-C_2H_5$ | $-C_2H_5$ |
| II-11 | $(CH_2)_2SO_3HN(C_2H_5)_3$ | $-C_2H_5$ | $(CH_2)_2SO_3^{\ominus}$ |
| II-12 | $(CH_2)_3SO_3HN(C_2H_5)_3$ | $-C_2H_5$ | $(CH_2)_3SO_3^{\ominus}$ |

-continued

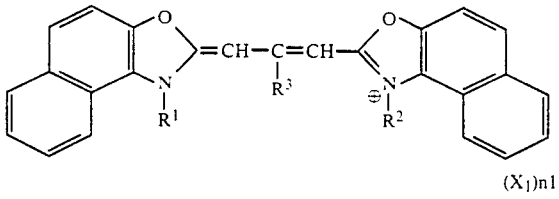

| Dye No. | $R^1$ | $R^3$ | $R^2$ |
|---|---|---|---|
| II-13 | $(CH_2)_2SO_3H.N(C_2H_5)_3$ | $-C_2H_5$ | $(CH_2)_2SO_3^{\ominus}$ |
| II-14 | $(CH_2)_3$ 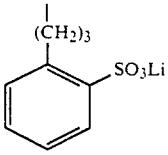 | $-C_2H_5$ | $CH_2$ 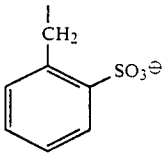 |
| II-15 | $(CH_2)_3SO_3H.N$ 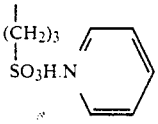 | $-C_2H_5$ | $(CH_2)_3SO_3^{\ominus}$ |
| II-16 | $-CH_2CH_2CH(SO_3Na)-CH_3$ | $-C_2H_5$ | $-CH_2CH_2CH(SO_3^{\ominus})-CH_3$ |
| II-17 | $-CH_2COOH$ | $-C_2H_5$ | $-(CH_2)_3SO_3^{\ominus}$ |
| II-18 | $-C_2H_5$ | $-C_2H_5$ | $-C_2H_5$ |
| II-19 | $-CH_2COOH$ | $-C_2H_5$ | $-CH_2COOH$ |

II-20
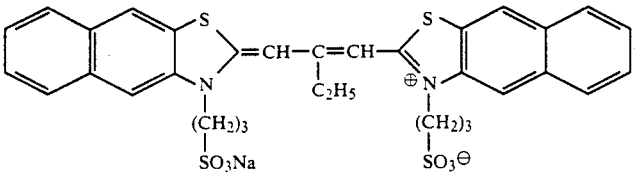
II-21
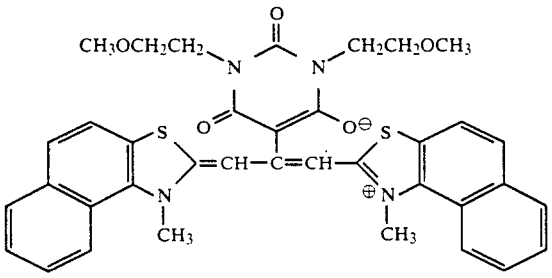
II-22
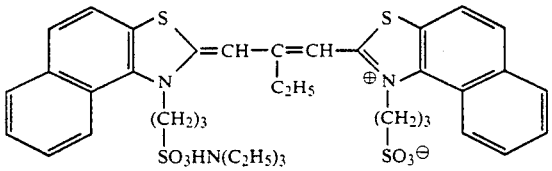
II-23
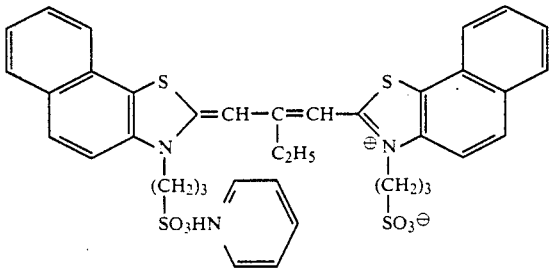
II-24
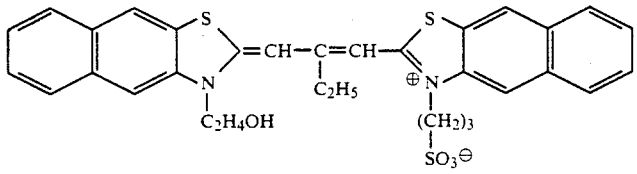
II-25
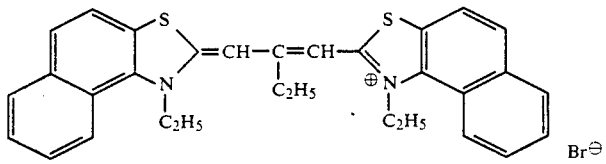
II-26
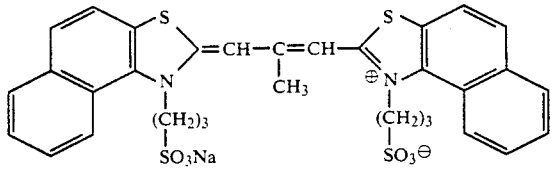

-continued
II-27
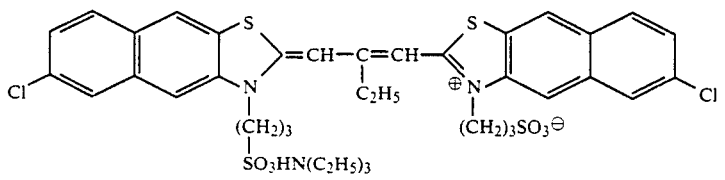
(iii) Compound of the general formula (III)
III-1
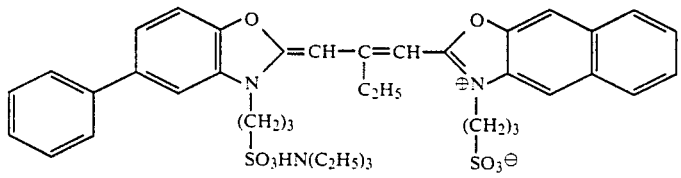
III-2
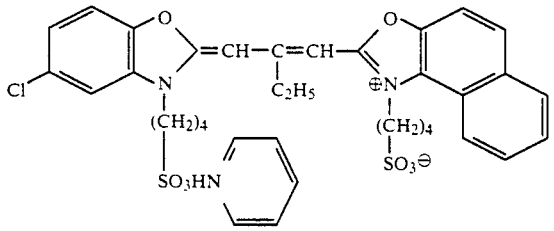
III-3
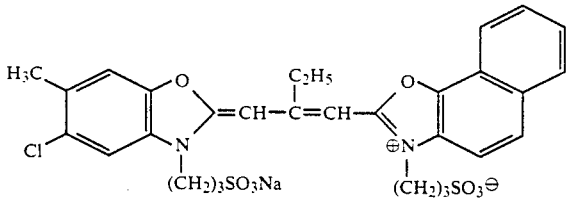
III-4
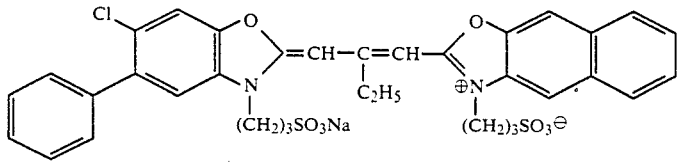
III-5
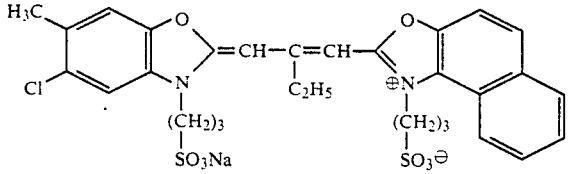
III-6
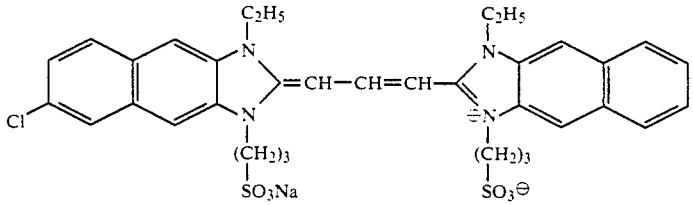

-continued
(iii) Compound of the general formula (III)
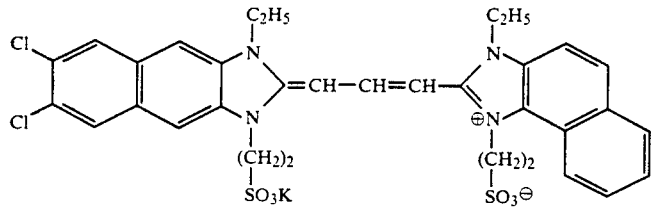
III-7
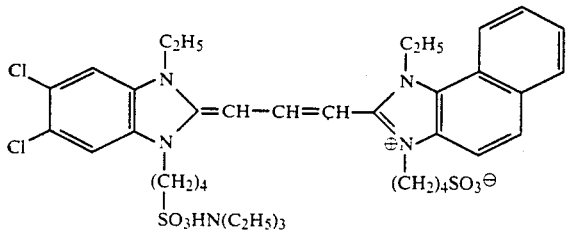
III-8
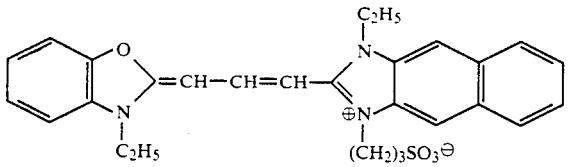
III-9
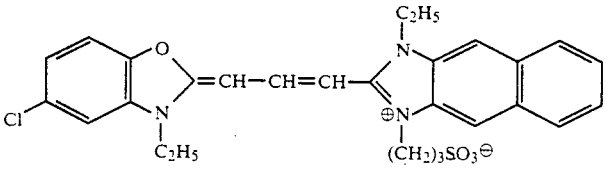
III-10
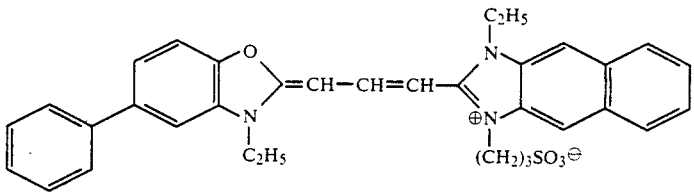
III-11
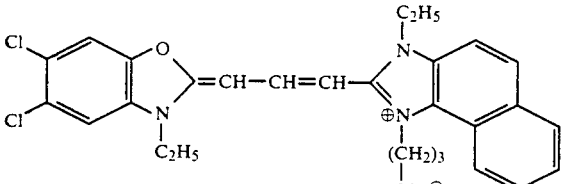
III-12
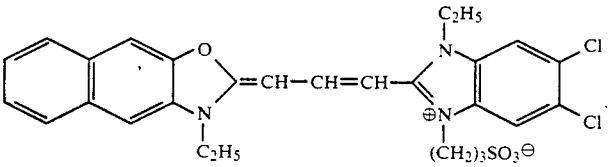
III-13
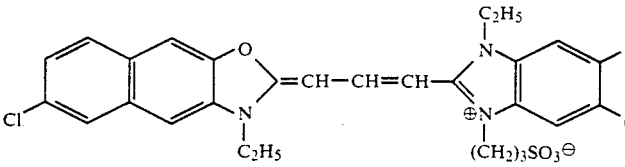
III-14

-continued (iii) Compound of the general formula (III)

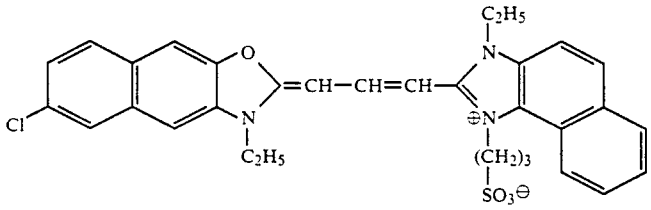

III-15

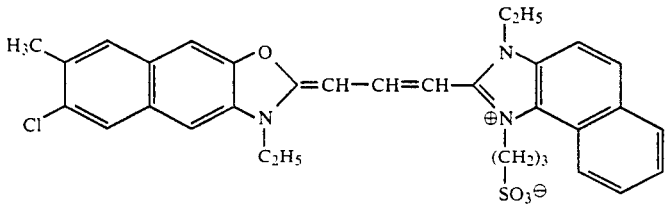

III-16

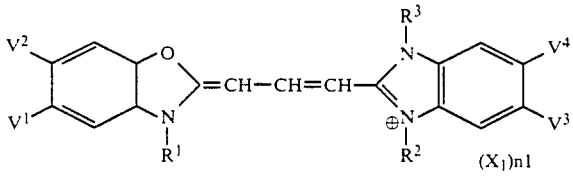

| Dye No. | $V^1$ | $V^2$ | $R^1$ | $R^2$ | $R^3$ | $V^3$ | $V^4$ |
|---|---|---|---|---|---|---|---|
| III-17 | H | H | $-C_2H_5$ | $-(CH_2)_4-SO_3^{\ominus}$ | $-C_2H_5$ | Cl | Cl |
| III-18 | $-Cl$ | $-CH_3$ | $-C_2H_5$ | $-(CH_2)_4-SO_3^{\ominus}$ | $-C_2H_5$ | $-COOC_2H_5$ | H |
| III-19 | $-Cl$ | H | $-C_2H_5$ | $-(CH_2)_3-SO_3^{\ominus}$ | $-C_2H_5$ | $-Cl$ | Cl |
| III-20 | $-Cl$ | H | $-C_2H_5$ | $-(CH_2)_3-SO_3^{\ominus}$ | $-C_2H_5$ | $-CF_3$ | Cl |
| III-21 | 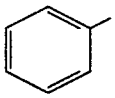 | H | $-C_2H_5$ | $-(CH_2)_3-SO_3^{\ominus}$ | $-C_2H_5$ | Cl | Cl |
| III-22 | 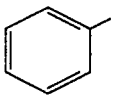 | H | $-C_2H_5$ | $-(CH_2)_3-SO_3^{\ominus}$ | $-C_2H_5$ | Cl | H |
| III-23 | Cl | H | $-(CH_2)_3-SO_3Na$ | $-(CH_2)_3-SO_3^{\ominus}$ | $-C_2H_5$ | $-CN$ | H |
| III-24 | Cl | H | $-(CH_2)_3-SO_3HN(C_2H_5)_3$ | $-(CH_2)_3-SO_3^{\ominus}$ | $-C_2H_5$ | $-CF_3$ | H |

-continued
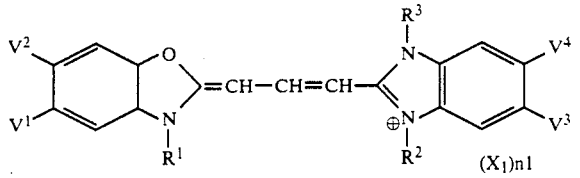
| Dye No. | $V^1$ | $V^2$ | $R^1$ | $R^2$ | $R^3$ | $V^3$ | $V^4$ |
|---|---|---|---|---|---|---|---|
| III-25 | $-CH_2CN$ | H | $-(CH_2)_2-SO_3^{\ominus}$ | $-C_2H_5$ | $-CH_2H_5$ | $-CF_3$ | H |
III-26
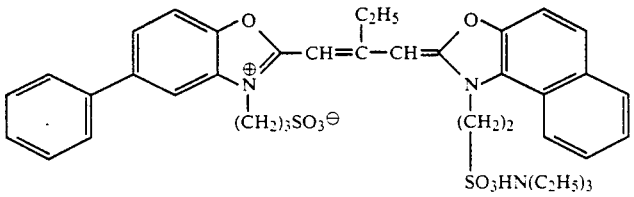
III-27
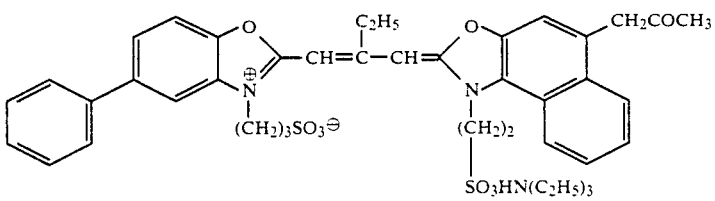
III-28
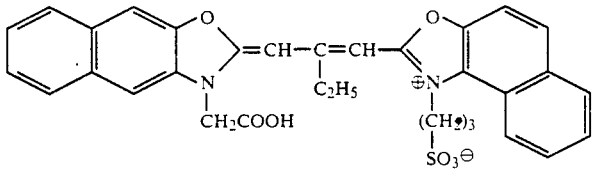
III-29
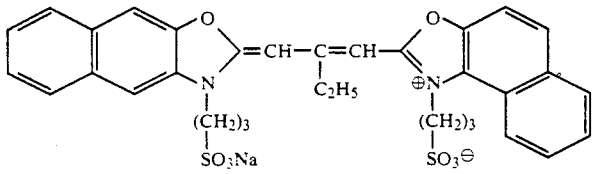
III-30
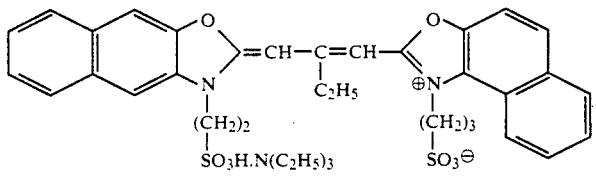
III-31
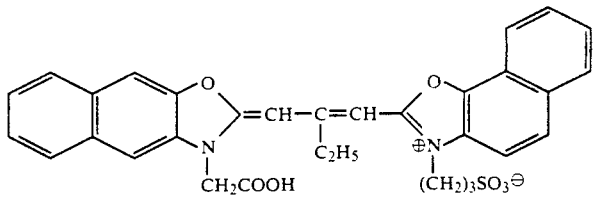

-continued
III-32
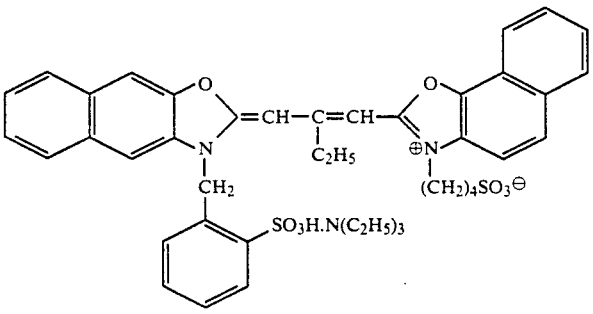
III-33
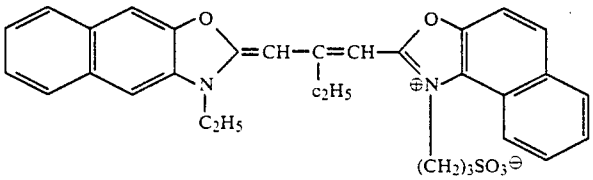
III-34
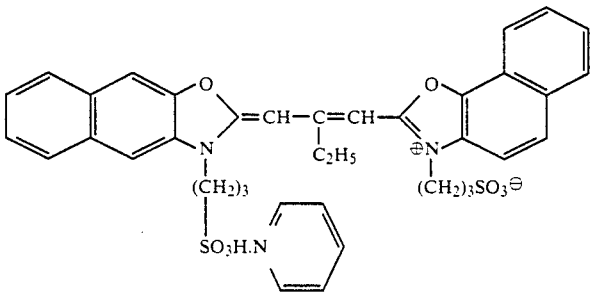
III-35
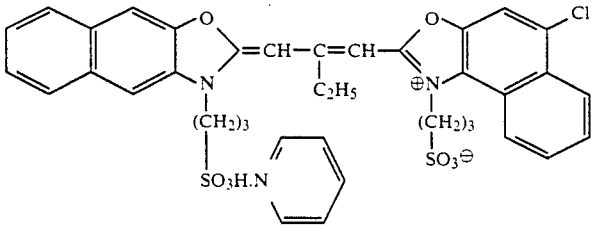
III-36
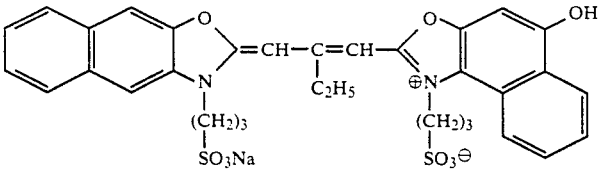
III-37
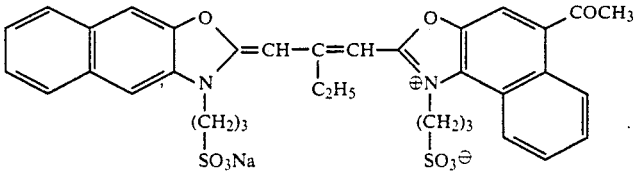
III-38
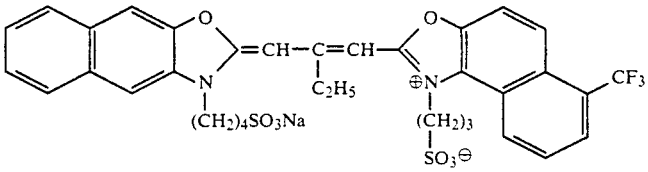

-continued
III-39
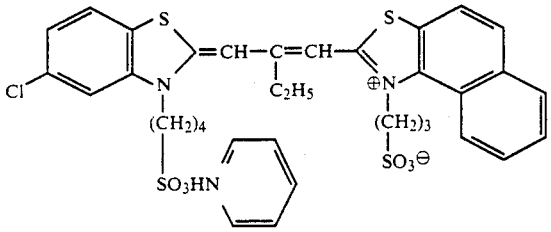
III-40
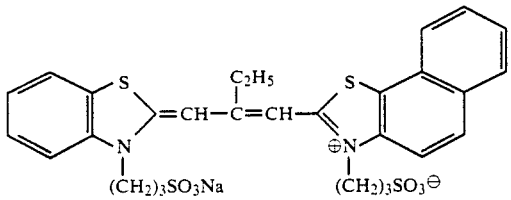
III-41
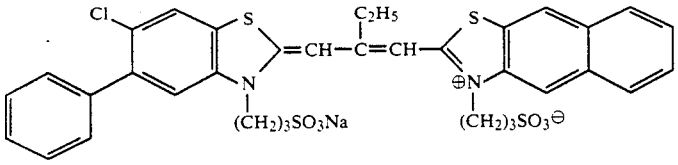
III-42
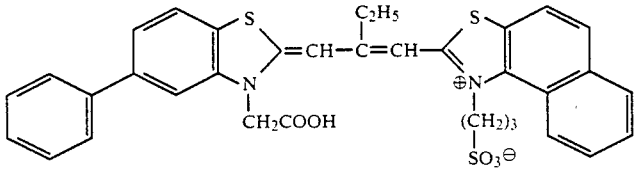
III-43
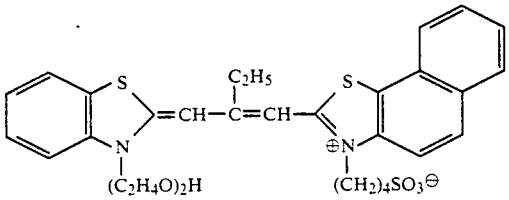
III-44
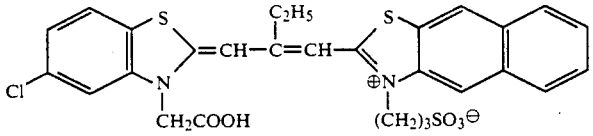
III-45
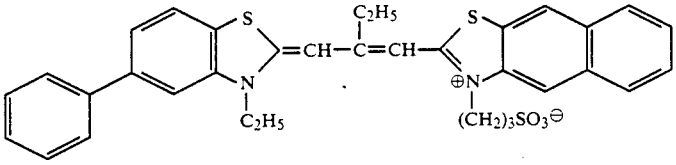
III-46
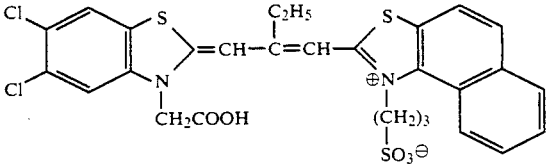

-continued

III-47

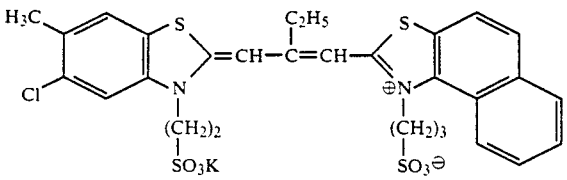

III-48

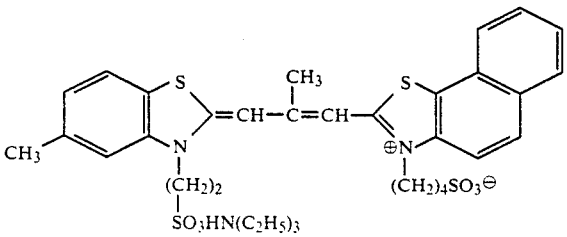

III-46

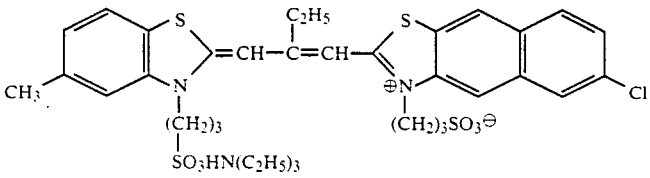

III-50

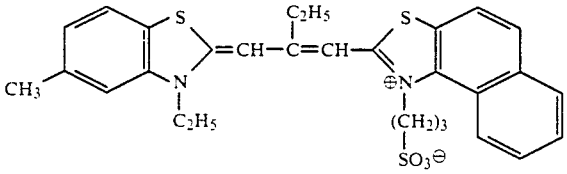

III-51

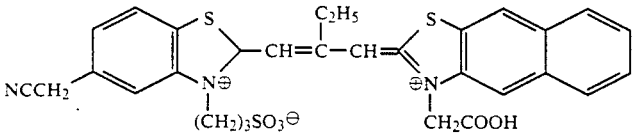

The spectral sensitizers represented by the general formulas (I), (II) and (III) which are used in the present invention can be easily synthesized by various methods such as those described in F. M. Hamer, "Heterocyclic Compounds-Cyanine Dyes and Related Compounds", Chapters IV, V and VI, Pp. 86–199, John Wiley & Sons, New York and London, 1964, and D. M. Sturmer, "Heterocyclic Compounds-Special Topics in Heterocyclic Chemistry", Chapter VIII, pp. 482–515, John Wiley & Sons, New York and London, 1977.

Each of the general structural formulas shown above is no more than the indication of one possible resonance structure and the same substance can be expressed by an extreme state in which a positive charge gets into the nitrogen atom in the symmetrical hetero rings.

The spectral sensitizers represented by the general formulas (I), (II) and (III) can be incorporated in silver halide emulsions by any known methods; for example, dissolution after protonation as described in JP-A-50-80826 and JP-A-50-80827, addition after dispersion together with surfactants as described in JP-B-49-44895 and JP-A-50-11419, addition as dispersions in hydrophilic substrates as described in U.S. Patent Nos. 3,676,147, 3,469,987, 4,247,627, JP-A-51-59942, JP-A-53-16624, JP-A-53-102732, JP-A-53-102733 and JP-A-53-137131, and addition as solid solutions as described in East German Patent No. 143,324. Another method that can be employed is to add spectral sensitizers after being dissolved in water or watermiscible solvents such as methanol, ethanol, propyl alcohol, acetone, fluorinated alcohols and dimethylformamide, which may be used either alone or in admixtures, as described in Research Disclosure No. 71802, JP-B-50-40659 and JP-B-59-14805. Spectral sensitizers may be added at any stage of the process of emulsion preparation but they are preferably added either during or after chemical ripening Adding the spectral sensitizers prior to or immediately after the addition of other sensitizing agents in the step of chemical ripening is particularly preferred since the induction period of sensitivity change can be shortened without causing a tonal change upon chemical ripening.

The spectral sensitizers represented by the general formulas (I), (II) and (III) may be added to emulsions in a total amount that is effective for increasing their sensitivity. Such an effective amount will vary over a broad range depending upon the emulsion to which they are added and the preferred range is from $1\times10^{-6}$ to $5\times10^{-3}$ moles per mole of silver halide, with the range of $3\times10^{-6}$ to $2.5\times10^{-3}$ moles being more preferred.

The proportions of the dyes of (I), (II) and (III) to be added may vary over a broad range depending upon the conditions of emulsions. Preferably, the ratio of (I) to (III) ranges from 0.05 to 20 and the ratio of (II) to (III)

also ranges from 0.05 to 20, with the more preferred range is from 0.1 to 10 for both ratios.

The silver halide emulsions to be used in the silver halide photographic material of the present invention may comprise the grains of any silver halides such as silver bromide, silver chloride, silver chlorobromide, silver iodobromide and silver chloroiodobromide. A silver iodobromide emulsion is particularly preferred since it attains high sensitivity.

The silver halide grains in a silver iodobromide emulsion have an average silver iodide (AgI) content of 0.5–10 mol %, preferably 1–8 mol %. These grains contain an internal localized region in which AgI is present at a high concentration of at least 20 mol %. Such an internal localized region is preferably located the farthest distance away from the outside surface of the grains and it is particularly preferred that this region is away from the outside surface of the grains by a distance of at least 0.01 μm.

The localized region may be in the form of a layer present within the grains. Alternatively, it may occupy the entire portion of the core of a "core/shell" type grain. In this case, part or all of the grain core excepting the shell having a thickness of at least 0.01 μm as measured from the outside surface is preferably a localized region having a AgI concentration of at least 20 mol %.

The silver iodide (AgI) content of the localized region is preferably within the range of 30–40 mol %.

The outside surface of the localized region is usually covered with a silver halide having low AgI contents. In a preferred embodiment, the shell portion covering a thickness of at least 0.01 μm, in particular 0.01–1.5 μm, as measured from the outside surface of the grain is formed of a silver halide containing AgI of no more than 6 mol %.

Seed crystals need not be used to form a localized region with a AgI content of at least 20 mol % within the grain, preferably at least 0.01 μm distant from its outside surface. In the absence of seed crystals, silver halides that will serve as growth nuclei prior to the start of ripening are not found in the phase of reaction solution containing protective gelatin (which is hereinafter referred to as the mother liquor). Thus, growth nuclei are first formed by supplying silver ions and halide ions that contain at least 20 mol % of iodine ions. Thereafter, additional ions are supplied to have grains grow from the growth nuclei. Finally, a AgI-free silver halide is added to form a shell layer having a thickness of at least 0.01 μm.

If seed crystals are to be used, at least 20 mol % of AgI is formed on them, followed by covering with a shell layer. Alternatively, the AgI content of the seed crystals is held at zero or adjusted to no more than 10 mol % and at least 20 mol % of AgI is formed within the growing seed grains, followed by covering with a shell layer.

The silver halide photographic material of the present invention is preferably such that at least 50% of the silver halide grains in emulsion layers have the AgI localized region described hereinabove.

In the present invention, a twinned crystal or a tabular crystal may be used, but in a preferred embodiment of the present invention, the silver halide photographic material uses silver halide grains with a regular structure or form that have the AgI localized region described hereinabove. The term "silver halide grains having a regular structure or form" as used herein means grains that do not involve an anisotropic growth such as twin planes but all of which will grow isotropically in shapes such as cubes, tetradecahedra, octahedra or spheres. The methods for preparing such regular silver halide grains are known and may be found in J. Phot. Sci., 5, 332 (1961), Ber. Bunsenges. Phys. Chem., 67, 949 (1963) and Intern. Congress Phot. Sci., Tokyo (1967).

Desired regular silver halide grains can be obtained by a double-jet method with proper control over the reaction conditions to be employed for the growth of silver halide grains. To prepare silver halide grains by a double-jet method, nearly equal amounts of a silver nitrate solution and a silver halide solution are added to an aqueous solution of protective colloid with vigorous stirring.

The silver and halide ions are preferably supplied at a critical growth rate at which the necessary and sufficient amount of silver halide for causing only the existing crystal grains to grow selectively without letting them dissolve away or permitting new grains to form and grow. Alternatively, the speed of grain growth may be increased continuously or stepwise over the permissible range of said critical growth rate. The latter method is described in such prior patents as JP-B-48-36890, JP-B-52-16364 and JP-A-55-142329.

The critical growth rate defined above will depend on various factors such as temperature, pH, pAg, the intensity of stirring, the composition of silver halide grains, their solubility, grain size, inter-grain distance, crystal habit, or the type and temperature of protective colloid, but it can be readily determined on an empirical basis by such methods as microscopic observation or turbidimetry of silver halide grains suspended in a liquid phase.

In a preferred embodiment, at least 50 wt % of the silver halide grains in silver halide emulsion layers are desirably regular grains of the kind described hereinabove.

According to another preferred embodiment, a monodispersed emulsion having the AgI localized region defined hereinabove may be used. The term "monodispersed emulsion" as used herein means such a silver halide emulsion in which at least 95% in number or weight of the grains are within ±40%, preferably ±30%, of the average grain size or diameter as measured by the method reported by Trivelli et al. in The Photographic Journal, 79, 330–338 (1939). The grains of such monodispersed emulsions can be prepared by a double-jet method as in the case of regular silver halide grains. The process conditions of the double-jet method are also the same as those employed in performing a double-jet method to prepare regular silver halide grains. Monodispersed emulsions can be prepared by any known methods such as those described in J. Phot. Sci., 12, 242–251 (1963), JP-A-48-36890, JP-A-52-16364, JP-A-55-142329 and JP-A-58-49938. Seed crystals are preferably used in preparing monodispersed emulsions. In this case, seed crystals are used as growth nuclei with silver and halide ions being supplied to effect grain growth. The broader the grain dize distribution of the seed crystals, the broader the grain size distribution of the growing nuclei. Thus, in order to obtain monodispersed emulsions, it is preferred to use seed crystals having a narrow grain size distribution.

The silver halide grains described hereinabove which are to be used in the silver halide photographic material of the present invention may be prepared by various methods including a neutral method, an acid method, an ammoniacal method, normal precipitation, reverse precipitation, a double-jet method, a controlled double-jet method, a conversion method and a core/shell method, which are described in T. H. James, "The Theory of the Photographic Process", 4th ed., Macmillan Publishing Company, pp. 38–104, 1977.

Known photographic additives may be incorporated in the silver halide photographic emulsions for use in the present invention. Known photographic additives are exemplified in the following table, with reference being made to Research Disclosure (RD) Nos. 17643 and 18716.

| Additive | RD-17643 | RD-18716 |
|---|---|---|
| Chemical sensitizer | p. 23, III | page 648, upper right col. |
| Spectral sensitizer | p. 23, IV | page 648, upper right col. |
| Development accelerator | p. 29, XX | page 648, upper right col. |
| Antifoggant | p. 24, VI | page 649, lower right col. |
| Stabilizer | p. 24, VI | page 649, lower right col. |
| Anti-color stain | p. 25, VII | page 650, left and right col. |
| Image stabilizer | p. 25, VII | |
| UV absorber | pp. 25–26, VII | page 649, right col. to page 650, left col. |
| Filter dye | pp. 25–26, VII | page 649, right col. to page 650, left col. |
| Brightener | p. 24, V | |
| Hardener | p. 26, X | page 651, right col. |
| Coating aid | pp. 26–27, XI | page 650, right col. |
| Surfactant | pp. 26–27, XI | page 650, right col. |
| Plasticizer | p. 27, XII | page 650, right col. |
| Antislip agent | p. 27, XII | |
| Antistat | p. 27, XII | page 650, right col. |
| Matting agent | p. 28, XVI | page 650, right col. |
| Binder | p. 26, IX | page 651, right col. |

The emulsion layers in the photographic material of the present invention contain dye-forming couplers that form dyes upon coupling reaction with the oxidized product of aromatic primary amino developing agents (e.g. p-phenylenediamine derivatives and aminophenol derivatives) during color development. Suitable dye-forming couplers are usually selected for respective emulsion layers in such a way that dyes will form that absorb spectral light to which the specific emulsion layers are sensitive. Thus, yellow-dye forming couplers are used in blue-sensitive emulsion layers, magenta-dye forming couplers in green-sensitive emulsion layers, and cyan-dye forming couplers in red-sensitive emulsion layers. It should however be noted that depending on the object, silver halide color photographic materials may be prepared using other combinations of couplers and emulsion layers.

The dye-forming couplers described above desirably contain in their molecule a ballast group, or a group having at least 8 carbon atoms which is capable of rendering the couplers nondiffusible. These couplers may be four-equivalent (i.e. four molecules of silver ion must be reduced to form one molecule of dye) or two-equivalent (i.e. only two molecules of silver ion need be reduced). Within the definition of "dye-forming couplers" are included colored couplers which are capable of color correction, as well as compounds that couple with the oxidized product of developing agent to release photographically useful fragments such as development restrainers, development accelerators, bleach accelerators, developers, silver halide solvents, toning agents, hardeners, foggants, antifoggants, chemical sensitizers, spectral sensitizers and desensitizers. Among those compounds, couplers that release development restrainers as development proceeds, thereby improving the sharpness or graininess are called DIR couplers. Such DIR couplers may be replaced by DIR compounds that enter into a coupling reaction with the oxidized product of developing agents to form colorless compounds as accompanied by the release of development restrainers.

Among the DIR couplers and DIR compounds that can be used are included those having a restrainer bonded directly at the coupling site, and those having a restrainer bonded at the coupling site via a divalent group in such a way that it will be released upon an intramolecular nucleophilic reaction or intramolecular electron transfer reaction within the group that has been eliminated by the coupling reaction. The second group of couplers and compounds are generally referred to as timing DIR couplers and timing DIR compounds. The released restrainer may be diffusible or comparatively nondiffusible and the two types of restrainers may be used either independently or as admixtures depending on the use. Dye-forming couplers may be used in combination with competitive couplers, or colorless couplers that enter into a coupling reaction with the oxidized product of aromatic primary amino developing agents but which will not form any dye.

Known acyl acetanilide couplers are preferably used as yellow-dye forming couplers. Benzoyl acetanilide and pivaloyl acetanilide compounds are particularly advantageous. Useful yellow color forming couplers are described in such prior patents as U.S. Pat. Nos. 2,875,057, 3,265,506, 3,408,194, 3,551,155, 3,582,322, 3,725,072 and 3,891,445, West German Patent No. 1,547,868, West German Patent Application (OLS) Nos. 2,219,917, 2,261,361 and 2,414,006, British Patent No. 1,425,020, JP-B-51-10783, JP-A-47-26133, JP-A-48-73147, JP-A-50-6341, JP-A-50-87650, JP-A-50-123342, JP-A-50-130442, JP-A-51-21827, JP-A-51-102636, JP-A-52-82424, JP-A-115219 and JP-A-58-95346.

Known 5-pyrazolone couplers, pyrazolobenzimidazole couplers, pyrazolotriazole couplers, open-chain acyl acetonitrile couplers and indazolone couplers may be used as magenta-dye forming couplers. Useful magenta color forming couplers are described in such prior patents as U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, West German Patent No. 1,810,464, West German Patent Application (OLS) Nos. 2,408,665, 2,417,945, 2,418,959 and 2,424,467, JP-B-40-6031, JP-A-49-74027, JP-A-49-74028, JP-A-49-129538, JP-A-50-60233, JP-A-50-159336, JP-A-51-20826, JP-A-51-26541, JP-A-52-42121, JP-A-52-58922 and JP-A-53-55122 and Japanese Patent Application No. 55-110943.

Known phenolic or naphtholic couplers may be used as cyan-dye forming couplers. Typical examples are phenolic couplers having such substituents as alkyl, acylamino and ureido groups, naphtholic couplers formed from a 5-aminonaphthol skeleton, and two-equivalentl naphtholic couplers having an oxygen atom introduced as a leaving group. Useful cyan color forming couplers are described in such prior patents as U.S. Pat. No. 3,779,763, JP-A-58-98731, JP-A-60-37557, U.S. Pat. No. 2,895,826, JP-A-60-225155, JP-A-60-222853, JP-A-59-185335, U.S. Pat. No. 3,488,193, JP-A-60-2377448, JP-A-53-52423, JP-A-54-48237, JP-A-56-27147, JP-B-49-11572, JP-A-61-3142, JP-A-61-9652, JP-A-61-9653, JP-A-61-39045, JP-A-61-50136, JP-A-61-99141 and JP-A-61-105545.

The silver halide photographic material of the present invention can be prepared by coating the necessary photographic layers onto a base support having a high degree of surface smoothness and which will not experience any substantial dimensional changes during its preparation or photographic processing. Useful base supports include, for example, cellulose nitrate films, cellulose ester films, polyvinyl acetal films, polystyrene films, polyethylene terephthalate films, polycarbonate films, glass, paper, metals, and paper coated with polyolefins such as polyethylene and polypropylene. These base supports may be subjected to various surface treatments such as those for rendering their surfaces hydrophilic with a view to improving the adhesion to photographic emulsion layers. Examples of such surface treatments are saponification, corona discharge, subbing and setting.

The silver halide photographic material of the present invention may be processed by known methods of photographic processing using known processing solutions in accordance with the teachings of Research Disclosure No. 176, pp. 20–30 (RD-17643). The methods employed may be of black-and-white photography for obtaining silver images or of color photography for obtaining dye images. The processing temperature is normally in the range of 18°–50° C. but processing can be effected even with temperatures lower than 18° C. or higher than 50° C.

The silver halide photographic material of the present invention may be used as a variety of color photographic materials (e.g. picture-taking color negative films, color reversal films, color prints, color positive films, color reversal prints, direct positive materials, heat processable materials and silver dye bleach materials) or black-and-white photographic materials (e.g. X-ray photographic materials, lithographic materials, microphotographic materials, picture-taking photographic materials and black-and-white prints).

The following examples are provided for the purpose of further illustrating the present invention but are in no way to be taken as limiting.

EXAMPLE 1

A silver iodobromide (8 mol % AgI on average) core/shell emulsion having an average grain size of 0.4 μm was prepared in accordance with the method described in JP-A-57-154232. This emulsion was referred to as Em No. 1.

After desalting, spectral sensitizers represented by the general formulas (I), (II) and (III) were added to the emulsion in the amounts indicated in Table 1. Additional samples were prepared by adding comparative dyes D-1 and D-2 having the structures shown below:

D-1

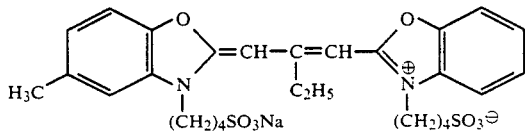

D-2

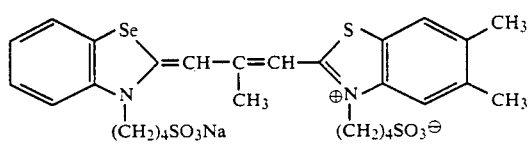

Subsequently, 4-hydroxy-6-methyl-1,3,3a, 7-tetrazaindene, sodium thiosulfate, chloroauric acid and ammonium thiocyanate were added and chemical ripening and spectral sensitization were performed under optimum conditions for the respective treatments.

To each of the emulsions thus treated, 4-hydroxy-6-methyl-1,3, 3a, 7-tetrazaindene and 1-phenyl-5-merocaptotetrazole (stabilizers), saponin (coating aid) and 1,2-bis(vinylsulfonyl)ethane (hardener) were added in appropriate amounts. Thereafter, magenta coupler (M-1) for sample Nos. 1–28 (to be described below) or cyan coupler (C-1) for sample Nos. 29–39 (also to be described below) and AS-1 (see below) were mixed with dodecyl galate, tricresyl phosphate and ethyl acetate and the resulting mixture was dispersed in an aqueous solution of sodium triisopropylnaphthalenesulfonate and gelatin and added to the emulsions.

Magenta coupler (M-1)

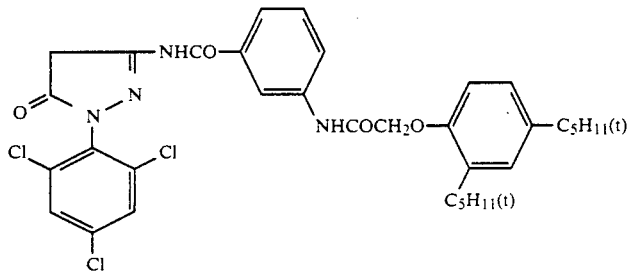

-continued

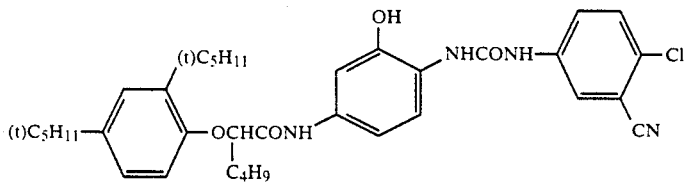

Cyan coupler (C-1)

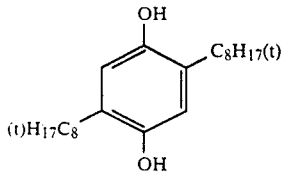

AS-1

The thus prepared emulsions were coated onto cellulose triacetate base supports and dried to prepare sample Nos. 1–39. These fresh samples were divided into two groups, one being left to stand for 3 days under ambient conditions and the other being left to stand for 3 days in a hot and humid atmosphere (50° C.×80% r.h.) to evaluate the raw stock stability of the photographic samples and the resistance of spectral sensitizers to description from silver halide.

The samples were wedge-exposed for 1/50 sec through either a green filter (for sample Nos. 1–28) or a red filter (for sample Nos. 29–39) and thereafter processed in accordance with the following scheme for the processing of color negative films.

| Processing Conditions | |
|---|---|
| Step (at 38° C.) | Time |
| Color development | 3 min and 15 sec |
| Bleaching | 6 min and 30 sec |
| Washing | 3 min and 15 sec |
| Fixing | 6 min and 30 sec |
| Washing | 3 min and 15 sec |
| Stabilizing | 1 min and 30 sec |

The processing solutions used in the respective steps had the following formulations.

| | |
|---|---|
| Color Developer: | |
| 4-Amino-3-methyl-N-ethyl-N-(β-hydroxyethyl)aniline sulfate | 4.8 g |
| Anhydrous sodium sulfite | 0.14 g |
| Hydroxylamine hemi-sulfate | 1.98 g |
| Sulfuric acid | 0.74 mg |
| Anhydrous potassium carbonate | 28.85 g |
| Anhydrous potassium hydrogensulfate | 3.46 g |
| Anhydrous potassium sulfite | 5.10 g |

-continued

| | |
|---|---|
| Potassium bromide | 1.16 g |
| Potassium chloride | 0.14 g |
| Nitrilotriacetic acid trisodium salt (monohydrate) | 1.20 g |
| Potassium hydroxide | 1.48 g |
| Water | to make 1,000 ml |
| Bleaching solution: | |
| Ethylenediaminetetraacetic acid iron (III) ammonium salt | 100.0 g |
| Ethylenediaminetetraacetic acid diammonium salt | 10.0 g |
| Ammonium bromide | 150.0 g |
| Glacial acetic acid | 10 ml |
| Water | to make 1,000 ml |
| pH adjusted to 6.0 with aqueous ammonia. | |
| Fixing solution: | |
| Ammonium thiosulfate | 175.0 g |
| Anhydrous sodium sulfite | 8.6 g |
| Sodium metasulfite | 2.3 g |
| Water | to make 1,000 ml |
| pH adjusted to 6.0 with acetic acid. | |
| Stabilizing solution: | |
| Formaldehyde (37% aq. sol.) | 1.5 ml |
| Konidax (Konica Corp.) | 7.5 ml |
| Water | to make 1,000 ml |

The dye images produced were subjected to sensitometry through a green or red filter to determine the sensitivity and fog of the samples under test. Sensitivity was calculated from the exposure amount necessary to provide an optical density of "fog+0.1". The results are shown in Table 1, in which sensitivity data are expressed in terms of relative values, with the value for fresh sample No. 1 being taken as 100 with respect to sample Nos. 1–17, the value for fresh sample No. 18 taken as 100 with respect to sample Nos. 18–28, and with the value for fresh sample No. 29 taken as 100 with respect to sample Nos. 29–39.

TABLE 1

| | Spectral sensitizer and its amount (mol/mol AgX) | | | As fresh | | After standing for 3 days at 50° C. × 80% r.h. | |
|---|---|---|---|---|---|---|---|
| Sample No. | Formula (I) | Formula (II) | Formula (III) | fog | sensitivity | fog | sensitivity |
| 1 (comparison) | I - 2 ($2.1 \times 10^{-4}$) | II - 1 ($2.1 \times 10^{-4}$) | — | 0.07 | 100 | 0.21 | 70 |
| 2 (comparison) | I - 2 ($1.4 \times 10^{-4}$) | II - 1 ($1.4 \times 10^{-4}$) | Comparative dye D-1 ($1.4 \times 10^{-4}$) | 0.07 | 110 | 0.20 | 75 |
| 3 | I - 2 ($1.4 \times 10^{-4}$) | II - 2 ($1.4 \times 10^{-4}$) | III - 1 ($1.4 \times 10^{-4}$) | 0.07 | 115 | 0.19 | 110 |
| 4 | I - 2 ($1.4 \times 10^{-4}$) | II - 1 ($1.4 \times 10^{-4}$) | III - 1 ($1.4 \times 10^{-4}$) | 0.07 | 150 | 0.15 | 140 |
| 5 | I - 2 ($1.4 \times 10^{-4}$) | II - 1 ($1.4 \times 10^{-4}$) | III - 4 ($1.4 \times 10^{-4}$) | 0.07 | 145 | 0.14 | 130 |
| 6 | I - 3 | II - 11 | — | 0.05 | 100 | 0.15 | 60 |

TABLE 1-continued

| Sample No. | Spectral sensitizer and its amount (mol/mol AgX) Formula (I) | Formula (II) | Formula (III) | As fresh fog | sensitivity | After standing for 3 days at 50° C. × 80% r.h. fog | sensitivity |
|---|---|---|---|---|---|---|---|
| (comparison) | ($2.1 \times 10^{-4}$) | ($2.1 \times 10^{-4}$) | | | | | |
| 7 | — | II - 11 | III - 2 | 0.05 | 80 | 0.17 | 50 |
| (comparison) | | ($2.1 \times 10^{-4}$) | ($2.1 \times 10^{-4}$) | | | | |
| 8 | I - 3 | — | III - 5 | 0.05 | 90 | 0.16 | 65 |
| (comparison) | ($2.1 \times 10^{-4}$) | | ($2.1 \times 10^{-4}$) | | | | |
| 9 | I - 3 | II - 11 | III - 2 | 0.05 | 160 | 0.11 | 130 |
| | ($1.4 \times 10^{-4}$) | ($1.4 \times 10^{-4}$) | ($1.4 \times 10^{-4}$) | | | | |
| 10 | I - 3 | II - 11 | III - 5 | 0.05 | 150 | 0.13 | 125 |
| | ($1.4 \times 10^{-4}$) | ($1.4 \times 10^{-4}$) | ($1.4 \times 10^{-4}$) | | | | |
| 11 | I - 3 | II - 12 | III - 2 | 0.05 | 160 | 0.11 | 125 |
| | ($1.4 \times 10^{-4}$) | ($1.4 \times 10^{-4}$) | ($1.4 \times 10^{-4}$) | | | | |
| 12 | I - 3 | II - 6 | — | 0.08 | 100 | 0.18 | 60 |
| (comparison) | ($2.4 \times 10^{-4}$) | ($1.8 \times 10^{-4}$) | | | | | |
| 13 | I - 15 | II - 1 | — | 0.08 | 105 | 0.18 | 60 |
| (comparison) | ($1.8 \times 10^{-4}$) | ($2.4 \times 10^{-4}$) | | | | | |
| 14 | I - 3 | II - 3 | III - 10 | 0.09 | 170 | 0.13 | 150 |
| | ($1.6 \times 10^{-4}$) | ($1.2 \times 10^{-4}$) | ($1.4 \times 10^{-4}$) | | | | |
| 15 | I - 3 | II - 3 | III - 9 | 0.09 | 165 | 0.15 | 145 |
| | ($1.6 \times 10^{-4}$) | ($1.2 \times 10^{-4}$) | ($1.4 \times 10^{-4}$) | | | | |
| 16 | I - 15 | II - 1 | III - 13 | 0.08 | 165 | 0.13 | 150 |
| | ($1.2 \times 10^{-4}$) | ($1.6 \times 10^{-4}$) | ($1.4 \times 10^{-4}$) | | | | |
| 17 | I - 15 | II - 1 | III - 14 | 0.08 | 165 | 0.12 | 140 |
| | ($1.2 \times 10^{-4}$) | ($1.6 \times 10^{-4}$) | ($1.4 \times 10^{-4}$) | | | | |
| 18 | I - 25 | II - 8 | — | 0.05 | 100 | 0.11 | 70 |
| (comparison) | ($2.1 \times 10^{-4}$) | ($2.1 \times 10^{-4}$) | | | | | |
| 19 | I - 25 | II - 8 | Comparative | 0.06 | 95 | 0.14 | 65 |
| (comparison) | ($1.4 \times 10^{-4}$) | ($1.4 \times 10^{-4}$) | dye D-1 | | | | |
| | | | ($1.4 \times 10^{-4}$) | | | | |
| 20 | I - 25 | II - 8 | III - 29 | 0.04 | 150 | 0.10 | 140 |
| | ($1.4 \times 10^{-4}$) | ($1.4 \times 10^{-4}$) | ($1.4 \times 10^{-4}$) | | | | |
| 21 | I - 25 | II - 8 | III - 30 | 0.04 | 165 | 0.10 | 155 |
| | ($1.4 \times 10^{-4}$) | ($1.4 \times 10^{-4}$) | ($1.4 \times 10^{-4}$) | | | | |
| 22 | I - 25 | II - 8 | III - 35 | 0.04 | 155 | 0.09 | 150 |
| | ($1.4 \times 10^{-4}$) | ($1.4 \times 10^{-4}$) | ($1.4 \times 10^{-4}$) | | | | |
| 23 | I - 22 | II - 13 | — | 0.05 | 100 | 0.11 | 65 |
| (comparison) | ($2.1 \times 10^{-4}$) | ($2.1 \times 10^{-4}$) | | | | | |
| 24 | — | II - 13 | III - 31 | 0.05 | 105 | 0.12 | 75 |
| (comparison) | | ($2.1 \times 10^{-4}$) | ($2.1 \times 10^{-4}$) | | | | |
| 25 | I - 22 | — | III - 31 | 0.05 | 110 | 0.11 | 70 |
| (comparison) | ($2.1 \times 10^{-4}$) | | ($2.1 \times 10^{-4}$) | | | | |
| 26 | I - 22 | II - 13 | III - 31 | 0.05 | 160 | 0.11 | 140 |
| | ($1.4 \times 10^{-4}$) | ($1.4 \times 10^{-4}$) | ($1.4 \times 10^{-4}$) | | | | |
| 27 | I - 22 | II - 13 | III - 32 | 0.04 | 145 | 0.09 | 140 |
| | ($1.4 \times 10^{-4}$) | ($1.4 \times 10^{-4}$) | ($1.4 \times 10^{-4}$) | | | | |
| 28 | I - 22 | II - 13 | III - 34 | 0.05 | 150 | 0.10 | 145 |
| | ($1.4 \times 10^{-4}$) | ($1.4 \times 10^{-4}$) | ($1.4 \times 10^{-4}$) | | | | |
| 29 | I - 32 | II - 22 | — | 0.05 | 100 | 0.09 | 70 |
| (comparison) | ($2.1 \times 10^{-4}$) | ($2.1 \times 10^{-4}$) | | | | | |
| 30 | I - 32 | II - 22 | Comparative | 0.05 | 95 | 0.09 | 60 |
| (comparison) | ($1.4 \times 10^{-4}$) | ($1.4 \times 10^{-4}$) | dye D-2 | | | | |
| | | | ($1.4 \times 10^{-4}$) | | | | |
| 31 | I - 32 | II - 22 | III - 39 | 0.04 | 150 | 0.08 | 150 |
| | ($1.4 \times 10^{-4}$) | ($1.4 \times 10^{-4}$) | ($1.4 \times 10^{-4}$) | | | | |
| 32 | I - 32 | II - 22 | III - 46 | 0.04 | 165 | 0.09 | 160 |
| | ($1.4 \times 10^{-4}$) | ($1.4 \times 10^{-4}$) | ($1.4 \times 10^{-4}$) | | | | |
| 33 | I - 33 | II - 22 | III - 39 | 0.04 | 155 | 0.08 | 150 |
| | ($1.4 \times 10^{-4}$) | ($1.4 \times 10^{-4}$) | ($1.4 \times 10^{-4}$) | | | | |
| 34 | I - 32 | II - 20 | — | 0.05 | 100 | 0.09 | 60 |
| (comparison) | ($2.1 \times 10^{-4}$) | ($2.1 \times 10^{-4}$) | | | | | |
| 35 | — | II - 20 | III - 44 | 0.06 | 105 | 0.10 | 65 |
| (comparison) | | ($2.1 \times 10^{-4}$) | ($2.1 \times 10^{-4}$) | | | | |
| 36 | I - 32 | — | III - 44 | 0.05 | 100 | 0.09 | 45 |
| (comparison) | ($2.1 \times 10^{-4}$) | | ($2.1 \times 10^{-4}$) | | | | |
| 37 | I - 32 | II - 20 | III - 44 | 0.05 | 185 | 0.08 | 165 |
| | ($1.4 \times 10^{-4}$) | ($1.4 \times 10^{-4}$) | ($1.4 \times 10^{-4}$) | | | | |
| 38 | I - 32 | II - 20 | III - 49 | 0.05 | 175 | 0.09 | 160 |
| | ($1.4 \times 10^{-4}$) | ($1.4 \times 10^{-4}$) | ($1.4 \times 10^{-4}$) | | | | |
| 39 | I - 33 | II - 20 | III - 44 | 0.05 | 170 | 0.07 | 160 |
| | ($1.4 \times 10^{-4}$) | ($1.4 \times 10^{-4}$) | ($1.4 \times 10^{-4}$) | | | | |

As is clear from the data shown in Table 1, the samples of the present invention which used spectral sensitizers of the general formulas (I), (II) and (III) in combination had higher sensitivity than the comparative samples which used combinations of only two symmetrical dyes or which additionally used dyes that did not have any partial structures common to those present in those symmetrical dyes. Further, the samples of the present invention were characterized by higher degrees of supersensitization and experienced less desensitization which would have otherwise occurred in a hostile hot and humid atmosphere on account of desorption of spectral sensitizers.

EXAMPLE 2

A core/shell emulsion (Em No. 2) for incorporation in an upper emulsion layer was prepared in accordance with Example 1. This emulsion had an average grain size of 0.7 μm and an average AgI content of 8 mol %. The emulsion prepared in Example 1 (Em No. 1) was used for incorporation in a lower emulsion layer. Each emulsion was sensitized to an optimum point and samples of multi-layered color photographic material (Nos. 101–139) were prepared.

The compositions of the upper and lower emulsion layers for each color and the additives used therein are shown in the following table with respect to sample Nos. 101–128.

| Layer | Main components | Amount used |
|---|---|---|
| First layer (HC) (anti-halation layer) | black coloidal silver | 0.20 |
| | gelatin | 1.5 |
| | u.v. absorber UV-1 | 0.1 |
| | u.v. absorber UV-2 | 0.2 |
| | dioctyl phthalate (DOP) | 0.03 |
| Second layer (IL-1) (Intermediate layer) | gelatin | 2.0 |
| | anti-stain agent (AS-1) | 0.1 |
| | DOP | 0.1 |
| Third layer (R-1) (first red-sensitive emulsion layer) | Em No. 1 | 1.2 |
| | gelatin | 1.1 |
| | spectral sensitizer I | $6 \times 10^{-5}$ |
| | spectral sensitizer II | $1 \times 10^{-5}$ |
| | coupler (C-1) | 0.06 |
| | coupler (CC-1) | 0.003 |
| | coupler (D-1) | 0.0015 |
| | coupler (D-2) | 0.002 |
| | DOP | 0.6 |
| Fourth layer (R-2) (second red-sensitive emulsion layer) | Em No. 2 | 1.0 |
| | gelatin | 1.1 |
| | spectral sensitizer I | $3 \times 10^{-5}$ |
| | spectral sensitizer II | $1 \times 10^{-5}$ |
| | coupler (C-1) | 0.03 |
| | coupler (D-2) | 0.001 |
| Fifth layer (IL-2) (intermediate layer) | gelatin | 0.8 |
| | AS-1 | 0.03 |
| | DOP | 0.1 |
| Sixth layer (G-1) (first green-sensitive emulsion layer) | Em No. 1 | 1.1 |
| | gelatin | 1.2 |
| | spectral sensitizer (see Table 2) | |
| | coupler (M-2) | 0.045 |
| | coupler (CM-1) | 0.009 |
| | coupler (D-1) | 0.001 |
| | coupler (D-3) | 0.003 |
| | tricresyl phosphate (TCP) | 0.5 |
| Seventh layer (G-2) (second green-sensitive emulsion layer) | Em No. 2 | 1.3 |
| | gelatin | 0.8 |
| | spectral sensitizer (see Table 2) | |
| | coupler (M-1) | 0.03 |
| | coupler (D-3) | 0.001 |
| | TCP | 0.3 |
| Eighth layer (YC) (yellow filter layer) | gelatin | 0.6 |
| | yellow colloidal silver | 0.008 |
| | AS-1 | 0.1 |
| | DOP | 0.3 |
| Ninth layer (B-1) (first blue-sensitive emulsion layer) | Em No. 1 | 0.5 |
| | gelatin | 1.1 |
| | spectral sensitizer III | $1.3 \times 10^{-5}$ |
| | coupler (Y-1) | 0.29 |
| | TCP | 0.2 |
| Tenth layer (B-2) (second blue-sensitive emulsion layer) | Em No. 2 | 0.7 |
| | gelatin | 1.2 |
| | spectral sensitizer III | $1 \times 10^{-5}$ |
| | coupler (Y-1) | 0.08 |
| | coupler (D-2) | 0.0015 |
| | TCP | 0.1 |
| Eleventh layer (Pro-1) (first protective layer) | gelatin | 0.55 |
| | u.v. absorber UV-1 | 0.1 |
| | u.v. absorber UV-2 | 0.2 |
| | DOP | 0.03 |
| | AgBrI (1 mol % AgI; average grain size, 0.07 μm) | 0.5 |
| Twelfth layer (Pro-2) (second protective layer) | gelatin | 0.5 |
| | polymethyl methacrylate particles (dia. 1.5 μm) | 0.2 |
| | formaldehyde scavenger (HS-1) | 3.0 |
| | hardener (H-1) | 0.4 |

Each of the layers 1–12 contained a surfactant as a coating aid in addition to the components described above.

Samples Nos. 129–139 were the same as sample Nos. 101–128 except that spectral sensitizers I and II in the third and fourth layers were replaced by those shown in Table 2 and that spectral sensitizer IV (see below) was used in the sixth and seventh layers.

The figures under "Amount used" in the above table refer to grams of silver per square meter for silver halide and colloidal silver and grams per square meter for additives and gelatin. The figures given in connection with couplers refer to moles per mole of silver halide in the same layer.

The samples prepared were processed and their performance evaluated as in Example 1. The results are shown in Table 2, in which sensitivity data are expressed in terms of relative values, with the value for fresh sample No. 101 being taken as 100 with respect to sample Nos. 101–117, the value for fresh sample No. 118 taken as 100 with respect to sample Nos. 118–128, and with the value for fresh sample 129 taken as 100 with respect to sample Nos. 129–139.

TABLE 2

| Sample No. | Em No. | Spectral sensitizer and its amount (mol/mol AgX) Formula (I) | Formula (II) | Formula (III) | As fresh fog | As fresh sensitivity | After standing for 3 days at 50° C. × 80% r.h. fog | After standing for 3 days at 50° C. × 80% r.h. sensitivity |
|---|---|---|---|---|---|---|---|---|
| 101 (comparison) | 1 | I-2 ($2.1 \times 10^{-4}$) | II-1 ($2.1 \times 10^{-4}$) | — | 0.11 | 100 | — | 50 |
| | 2 | I-2 ($1.1 \times 10^{-4}$) | II-1 ($1.1 \times 10^{-4}$) | | | | | |
| 102 (comparison) | 1 | I-2 ($1.4 \times 10^{-4}$) | II-1 ($1.4 \times 10^{-4}$) | Comparative dye D-1 ($1.4 \times 10^{-4}$) | 0.11 | 105 | — | 55 |
| | 2 | I-2 ($0.7 \times 10^{-4}$) | II-1 ($0.7 \times 10^{-4}$) | Comparative dye D-1 ($0.7 \times 10^{-4}$) | | | | |
| 103 | 1 | I-2 ($1.4 \times 10^{-4}$) | II-2 ($1.4 \times 10^{-4}$) | III-1 ($1.4 \times 10^{-4}$) | 0.11 | 205 | — | 190 |

TABLE 2-continued

| Sample No. | Em No. | Spectral sensitizer and its amount (mol/mol AgX) Formula (I) | Formula (II) | Formula (III) | As fresh fog | As fresh sensitivity | After standing for 3 days at 50° C. × 80% r.h. fog | After standing for 3 days at 50° C. × 80% r.h. sensitivity |
|---|---|---|---|---|---|---|---|---|
| | 2 | I-2 ($0.7 \times 10^{-4}$) | II-2 ($0.7 \times 10^{-4}$) | III-1 ($0.7 \times 10^{-4}$) | | | | |
| 104 | 1 | I-2 ($1.4 \times 10^{-4}$) | II-1 ($1.4 \times 10^{-4}$) | III-1 ($1.4 \times 10^{-4}$) | 0.11 | 190 | — | 180 |
| | 2 | I-2 ($0.7 \times 10^{-4}$) | II-1 ($0.7 \times 10^{-4}$) | III-1 ($0.7 \times 10^{-4}$) | | | | |
| 105 | 1 | I-2 ($1.4 \times 10^{-4}$) | II-1 ($1.4 \times 10^{-4}$) | III-4 ($1.4 \times 10^{-4}$) | 0.11 | 200 | — | 185 |
| | 2 | I-2 ($0.7 \times 10^{-4}$) | II-1 ($0.7 \times 10^{-4}$) | III-4 ($0.7 \times 10^{-4}$) | | | | |
| 106 (comparison) | 1 | I-3 ($2.1 \times 10^{-4}$) | II-11 ($2.1 \times 10^{-4}$) | — | 0.10 | 100 | — | 40 |
| | 2 | I-3 ($1.1 \times 10^{-4}$) | II-11 ($1.1 \times 10^{-4}$) | | | | | |
| 107 (comparison) | 1 | — | II-11 ($2.1 \times 10^{-4}$) | III-2 ($2.1 \times 10^{-4}$) | 0.10 | 90 | — | 45 |
| | 2 | | II-11 ($1.1 \times 10^{-4}$) | III-2 ($1.1 \times 10^{-4}$) | | | | |
| 108 (comparison) | 1 | I-3 ($1.4 \times 10^{-4}$) | — | III-5 ($2.1 \times 10^{-4}$) | 0.10 | 105 | — | 45 |
| | 2 | I-3 ($0.7 \times 10^{-4}$) | | III-5 ($1.1 \times 10^{-4}$) | | | | |
| 109 | 1 | I-3 ($1.4 \times 10^{-4}$) | II-11 ($1.4 \times 10^{-4}$) | III-2 ($1.4 \times 10^{-4}$) | 0.10 | 210 | — | 195 |
| | 2 | I-3 ($0.7 \times 10^{-4}$) | II-11 ($0.7 \times 10^{-4}$) | III-2 ($0.7 \times 10^{-4}$) | | | | |
| 110 | 1 | I-3 ($1.4 \times 10^{-4}$) | II-11 ($1.4 \times 10^{-4}$) | III-5 ($1.4 \times 10^{-4}$) | 0.10 | 205 | — | 190 |
| | 2 | I-3 ($0.7 \times 10^{-4}$) | II-11 ($0.7 \times 10^{-4}$) | III-5 ($0.7 \times 10^{-4}$) | | | | |
| 111 | 1 | I-3 ($1.4 \times 10^{-4}$) | II-12 ($1.4 \times 10^{-4}$) | III-2 ($1.4 \times 10^{-4}$) | 0.10 | 205 | — | 195 |
| | 2 | I-3 ($0.7 \times 10^{-4}$) | II-12 ($0.7 \times 10^{-4}$) | III-2 ($0.7 \times 10^{-4}$) | | | | |
| 112 (comparison) | 1 | I-3 ($2.4 \times 10^{-4}$) | II-3 ($1.8 \times 10^{-4}$) | — | 0.13 | 100 | — | 35 |
| | 2 | I-3 ($1.2 \times 10^{-4}$) | II-3 ($0.9 \times 10^{-4}$) | | | | | |
| 113 (comparison) | 1 | I-15 ($1.8 \times 10^{-4}$) | II-1 ($2.4 \times 10^{-4}$) | — | 0.13 | 110 | — | 30 |
| | 2 | I-15 ($0.9 \times 10^{-4}$) | II-1 ($1.2 \times 10^{-4}$) | | | | | |
| 114 | 1 | I-3 ($1.6 \times 10^{-4}$) | II-3 ($1.2 \times 10^{-4}$) | III-9 ($1.4 \times 10^{-4}$) | 0.15 | 220 | — | 195 |
| | 2 | I-3 ($0.8 \times 10^{-4}$) | II-3 ($0.6 \times 10^{-4}$) | III-9 ($0.7 \times 10^{-4}$) | | | | |
| 115 | 1 | I-3 ($1.6 \times 10^{-4}$) | II-3 ($1.2 \times 10^{-4}$) | III-10 ($1.4 \times 10^{-4}$) | 0.15 | 200 | — | 190 |
| | 2 | I-3 ($0.8 \times 10^{-4}$) | II-3 ($0.6 \times 10^{-4}$) | III-10 ($0.7 \times 10^{-4}$) | | | | |
| 116 | 1 | I-15 ($1.2 \times 10^{-4}$) | II-1 ($1.6 \times 10^{-4}$) | III-13 ($1.4 \times 10^{-4}$) | 0.14 | 205 | — | 200 |
| | 2 | I-15 ($0.6 \times 10^{-4}$) | II-1 ($0.8 \times 10^{-4}$) | III-13 ($0.7 \times 10^{-4}$) | | | | |
| 117 | 1 | I-15 ($1.2 \times 10^{-4}$) | II-1 ($1.6 \times 10^{-4}$) | III-14 ($1.4 \times 10^{-4}$) | 0.14 | 195 | — | 190 |
| | 2 | I-15 ($0.6 \times 10^{-4}$) | II-1 ($0.8 \times 10^{-4}$) | III-14 ($0.7 \times 10^{-4}$) | | | | |
| 118 (comparison) | 1 | I-22 ($2.1 \times 10^{-4}$) | II-7 ($2.1 \times 10^{-4}$) | — | 0.11 | 100 | 0.31 | 55 |
| | 2 | I-22 ($1.1 \times 10^{-4}$) | II-7 ($1.1 \times 10^{-4}$) | | | | | |
| 119 (comparison) | 1 | I-22 ($1.4 \times 10^{-4}$) | II-7 ($1.4 \times 10^{-4}$) | Comparitive dye D-1 ($1.4 \times 10^{-4}$) | 0.11 | 105 | 0.30 | 55 |
| | 2 | I-22 ($0.7 \times 10^{-4}$) | II-7 ($0.7 \times 10^{-4}$) | Comparative dye D-1 ($0.7 \times 10^{-4}$) | | | | |
| 120 | 1 | I-22 ($1.4 \times 10^{-4}$) | II-7 ($1.4 \times 10^{-4}$) | III-29 ($1.4 \times 10^{-4}$) | 0.11 | 205 | 0.27 | 190 |
| | 2 | I-22 ($0.7 \times 10^{-4}$) | II-7 ($0.7 \times 10^{-4}$) | III-29 ($0.7 \times 10^{-4}$) | | | | |
| 121 | 1 | I-23 ($1.4 \times 10^{-4}$) | II-7 ($1.4 \times 10^{-4}$) | III-30 ($1.4 \times 10^{-4}$) | 0.11 | 190 | 0.27 | 185 |
| | 2 | I-23 ($0.7 \times 10^{-4}$) | II-7 ($0.7 \times 10^{-4}$) | III-30 ($0.7 \times 10^{-4}$) | | | | |
| 122 | 1 | I-23 ($1.4 \times 10^{-4}$) | II-7 ($1.4 \times 10^{-4}$) | III-35 ($1.4 \times 10^{-4}$) | 0.11 | 200 | 0.29 | 190 |

TABLE 2-continued

| Sample No. | Em No. | Spectral sensitizer and its amount (mol/mol AgX) Formula (I) | Formula (II) | Formula (III) | As fresh fog | As fresh sensitivity | After standing for 3 days at 50° C. × 80% r.h. fog | After standing for 3 days at 50° C. × 80% r.h. sensitivity |
|---|---|---|---|---|---|---|---|---|
| | 2 | I-23 ($0.7 \times 10^{-4}$) | II-7 ($0.7 \times 10^{-4}$) | III-35 ($0.7 \times 10^{-4}$) | | | | |
| 123 (comparison) | 1 | I-24 ($2.1 \times 10^{-4}$) | II-17 ($2.1 \times 10^{-4}$) | — | 0.10 | 100 | 0.33 | 55 |
| | 2 | I-24 ($1.1 \times 10^{-4}$) | II-17 ($1.1 \times 10^{-4}$) | | | | | |
| 124 (comparison) | 1 | — | II-17 ($2.1 \times 10^{-4}$) | III-31 ($2.1 \times 10^{-4}$) | 0.10 | 100 | 0.30 | 60 |
| | 2 | | II-17 ($1.1 \times 10^{-4}$) | III-31 ($1.1 \times 10^{-4}$) | | | | |
| 125 (comparison) | 1 | I-24 ($1.4 \times 10^{-4}$) | — | III-31 ($2.1 \times 10^{-4}$) | 0.10 | 95 | 0.31 | 65 |
| | 2 | I-24 ($0.7 \times 10^{-4}$) | | III-31 ($1.1 \times 10^{-4}$) | | | | |
| 126 | 1 | I-24 ($1.4 \times 10^{-4}$) | II-17 ($1.4 \times 10^{-4}$) | III-31 ($1.4 \times 10^{-4}$) | 0.10 | 185 | 0.25 | 185 |
| | 2 | I-24 ($0.7 \times 10^{-4}$) | II-17 ($0.7 \times 10^{-4}$) | III-31 ($0.7 \times 10^{-4}$) | | | | |
| 127 | 1 | I-24 ($1.4 \times 10^{-4}$) | II-17 ($1.4 \times 10^{-4}$) | III-32 ($1.4 \times 10^{-4}$) | 0.09 | 200 | 0.24 | 190 |
| | 2 | I-24 ($0.7 \times 10^{-4}$) | II-17 ($0.7 \times 10^{-4}$) | III-32 ($0.7 \times 10^{-4}$) | | | | |
| 128 | 1 | I-24 ($1.4 \times 10^{-4}$) | II-17 ($1.4 \times 10^{-4}$) | III-34 ($1.4 \times 10^{-4}$) | 0.10 | 205 | 0.25 | 195 |
| | 2 | I-24 ($0.7 \times 10^{-4}$) | II-17 ($0.7 \times 10^{-4}$) | III-34 ($0.7 \times 10^{-4}$) | | | | |
| 129 (comparison) | 1 | I-42 ($2.1 \times 10^{-4}$) | II-22 ($2.1 \times 10^{-4}$) | — | 0.11 | 100 | 0.40 | 50 |
| | 2 | I-42 ($1.1 \times 10^{-4}$) | II-22 ($1.1 \times 10^{-4}$) | | | | | |
| 130 (comparison) | 1 | I-42 ($1.4 \times 10^{-4}$) | II-22 ($1.4 \times 10^{-4}$) | Comparative dye D-2 ($1.4 \times 10^{-4}$) | 0.11 | 100 | 0.44 | 45 |
| | 2 | I-42 ($0.7 \times 10^{-4}$) | II-22 ($0.7 \times 10^{-4}$) | Comparative dye D-2 ($0.7 \times 10^{-4}$) | | | | |
| 131 | 1 | I-42 ($1.4 \times 10^{-4}$) | II-22 ($1.4 \times 10^{-4}$) | III-39 ($1.4 \times 10^{-4}$) | 0.11 | 205 | 0.35 | 190 |
| | 2 | I-42 ($0.7 \times 10^{-4}$) | II-22 ($0.7 \times 10^{-4}$) | III-39 ($0.7 \times 10^{-4}$) | | | | |
| 132 | 1 | I-42 ($1.4 \times 10^{-4}$) | II-22 ($1.4 \times 10^{-4}$) | III-46 ($1.4 \times 10^{-4}$) | 0.11 | 190 | 0.36 | 180 |
| | 2 | I-42 ($0.7 \times 10^{-4}$) | II-22 ($0.7 \times 10^{-4}$) | III-46 ($0.7 \times 10^{-4}$) | | | | |
| 133 | 1 | I-33 ($1.4 \times 10^{-4}$) | II-22 ($1.4 \times 10^{-4}$) | III-50 ($1.4 \times 10^{-4}$) | 0.11 | 200 | 0.36 | 185 |
| | 2 | I-33 ($0.7 \times 10^{-4}$) | II-22 ($0.7 \times 10^{-4}$) | III-50 ($0.7 \times 10^{-4}$) | | | | |
| 134 (comparison) | 1 | I-42 ($2.1 \times 10^{-4}$) | II-20 ($2.1 \times 10^{-4}$) | — | 0.10 | 100 | 0.44 | 45 |
| | 2 | I-42 ($1.1 \times 10^{-4}$) | II-20 ($1.1 \times 10^{-4}$) | | | | | |
| 135 (comparison) | 1 | — | II-20 ($2.1 \times 10^{-4}$) | III-44 ($2.1 \times 10^{-4}$) | 0.10 | 100 | 0.42 | 50 |
| | 2 | | II-20 ($1.1 \times 10^{-4}$) | III-44 ($1.1 \times 10^{-4}$) | | | | |
| 136 (comparison) | 1 | I-42 ($1.4 \times 10^{-4}$) | — | III-44 ($2.1 \times 10^{-4}$) | 0.11 | 100 | 0.44 | 45 |
| | 2 | I-42 ($0.7 \times 10^{-4}$) | | III-44 ($1.1 \times 10^{-4}$) | | | | |
| 137 | 1 | I-42 ($1.4 \times 10^{-4}$) | II-20 ($1.4 \times 10^{-4}$) | III-44 ($1.4 \times 10^{-4}$) | 0.10 | 160 | 0.35 | 145 |
| | 2 | I-42 ($0.7 \times 10^{-4}$) | II-20 ($0.7 \times 10^{-4}$) | III-44 ($0.7 \times 10^{-4}$) | | | | |
| 138 | 1 | I-42 ($1.4 \times 10^{-4}$) | II-20 ($1.4 \times 10^{-4}$) | III-49 ($1.4 \times 10^{-4}$) | 0.10 | 150 | 0.34 | 145 |
| | 2 | I-42 ($0.7 \times 10^{-4}$) | II-20 ($0.7 \times 10^{-4}$) | III-49 ($0.7 \times 10^{-4}$) | | | | |
| 139 | 1 | I-35 ($1.4 \times 10^{-4}$) | II-20 ($1.4 \times 10^{-4}$) | III-51 ($1.4 \times 10^{-4}$) | 0.09 | 155 | 0.34 | 150 |
| | 2 | I-35 ($0.7 \times 10^{-4}$) | II-20 ($0.7 \times 10^{-4}$) | III-51 ($0.7 \times 10^{-4}$) | | | | |

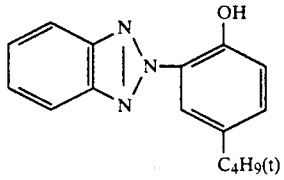
UV-1
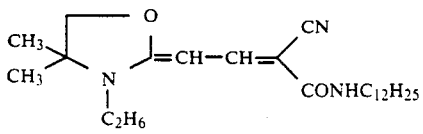
UV-2
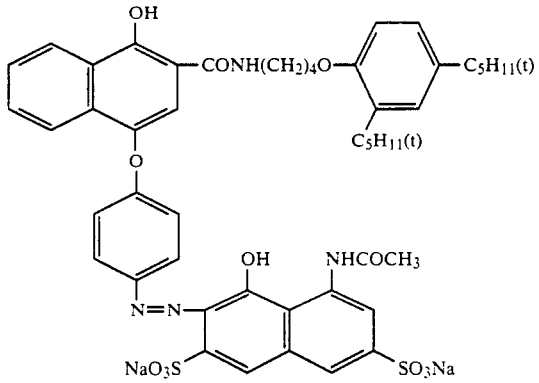
CC-1
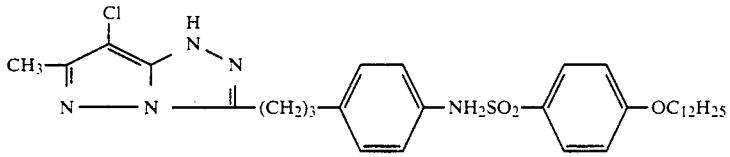
M-2
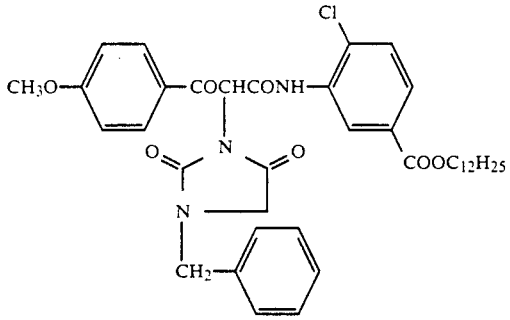
Y-1
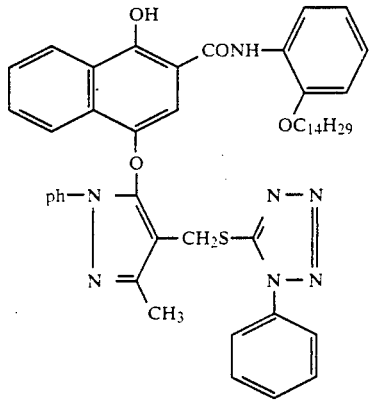
D-1

-continued

D-2

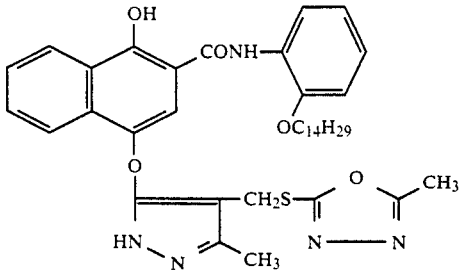

D-3

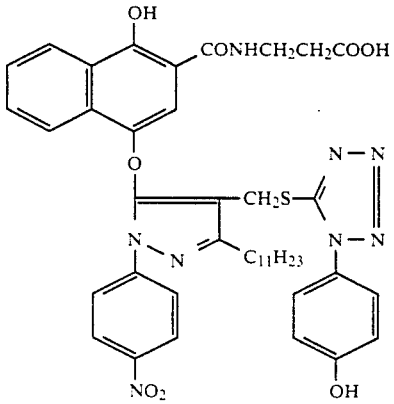

Spectral sensitizer I

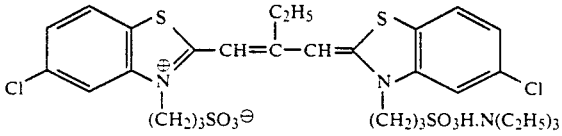

Spectral sensitizer II

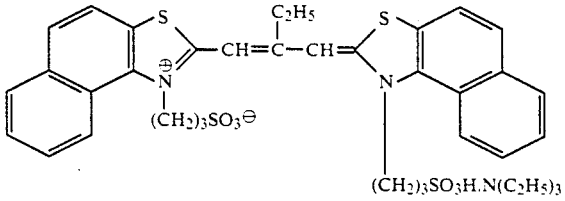

Spectral sensitizer III

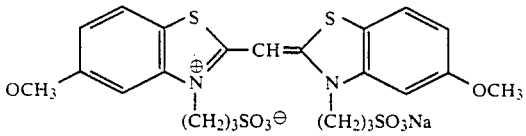

Spectral sensitizer IV

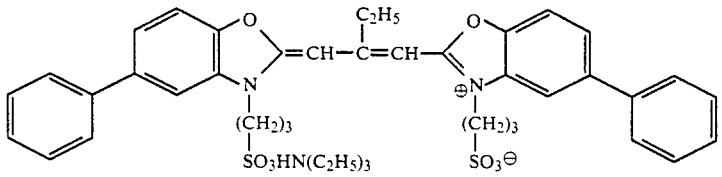

HS-1

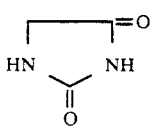

As is clear from the data shown in Table 2, the problem of desensitization which occurred on account of desorption of spectral sensitizers in photographic materials of a multi-layered structure could successfully be solved by using two symmetrical dyes in combination with one asymmetrical dye having partial structures common to one of those in the symmetrical dyes. While such combination of dyes was also effective in preventing the occurrence of desensitization due to desorption of spectral sensitizers in single-layered photographic materials, its effectiveness was greater in multi-layered structures.

EXAMPLE 3

A monodispersed AgBrI emulsion comprising cubic grains having an average size of 0.75 μm was prepared by a double-jet method. The average AgI content of this emulsion was 2.0 mol %. After desalting, the emulsion was chemically ripened by gold-sulfur sensitization and spectral sensitizers represented by the general formulas (I), (II) and (III) were added in the amounts shown in Table 3. After a maximum sensitivity was attained, 4-hydroxy-6-methyl-1,3,3a,7-tetrazaindene was added as a stabilizer.

To each of the high-sensitivity AgBrI emulsions obtained, a styrene/maleic anhydride copolymer (thickener) and trimethylol-propane and diethylene glycol (both as a wetting agent) were added in suitable amounts. Thereafter, sodium-isoamyl-N-decyl-sulfosuccinate (coating aid) and formaldehyde (hardener) were added in suitable amounts and the coating solutions were applied uniformly to a polyethylene terephthalate base film to give a silver deposit of 3 g/m$^2$. The thus prepared sample Nos. 201–239 were divided into two groups, one being left to stand for 3 days at 50° C. and 80% r.h. (storage test) and the other being kept fresh.

These samples were exposed under a Model KS-1 sensitometer (Konica Corp.) according to the JIS method and developed with a developer (XD-90) for 30 sec at 35° C. in a Model KX-5000 automatic processor (Konica Corp.). After fixing, washing and drying, the samples were evaluated for performance as in Example 1 and the results are shown in Table 3, in which sensitivity data are expressed in terms of relative values, with the value for fresh sample No. 201 being taken as 100 with respect to sample Nos. 201–217, the value for fresh sample No. 218 taken as 100 with respect to sample Nos. 218–228, and with the value for fresh sample No. 229 taken as 100 with respect to sample Nos. 229–239.

As is clear from the data shown in Table 3, excellent photographic characteristics were also obtained when the concept of the present invention was applied to black-and-white photographic materials.

TABLE 3

| | Spectral sensitizer and its amount (mol/mol AgX) | | | As fresh | | After standing for 3 days at 50° C. × 80% r.h. | |
|---|---|---|---|---|---|---|---|
| Sample No. | Formula (I) | Formula (II) | Formula (III) | fog | sensitivity | fog | sensitivity |
| 201 (comparison) | I-2 ($2.1 \times 10^{-4}$) | II-1 ($2.1 \times 10^{-4}$) | — | 0.03 | 100 | 0.09 | 80 |
| 202 (comparison) | I-2 ($1.4 \times 10^{-4}$) | II-1 ($1.4 \times 10^{-4}$) | Comparative dye D-1 ($1.4 \times 10^{-4}$) | 0.03 | 105 | 0.08 | 78 |
| 203 | I-2 ($1.4 \times 10^{-4}$) | II-2 ($1.4 \times 10^{-4}$) | III-1 ($1.4 \times 10^{-4}$) | 0.02 | 140 | 0.10 | 120 |
| 204 | I-2 ($1.4 \times 10^{-4}$) | II-1 ($1.4 \times 10^{-4}$) | III-1 ($1.4 \times 10^{-4}$) | 0.03 | 155 | 0.05 | 133 |
| 205 | I-2 ($1.4 \times 10^{-4}$) | II-1 ($1.4 \times 10^{-4}$) | III-4 ($1.4 \times 10^{-4}$) | 0.03 | 145 | 0.06 | 130 |
| 206 (comparison) | I-3 ($2.1 \times 10^{-4}$) | II-11 ($2.1 \times 10^{-4}$) | — | 0.04 | 100 | 0.08 | 78 |
| 207 (comparison) | — | II-11 ($2.1 \times 10^{-4}$) | III-2 ($2.1 \times 10^{-4}$) | 0.04 | 85 | 0.07 | 80 |
| 208 (comparison) | I-3 ($2.1 \times 10^{-4}$) | — | III-5 ($2.1 \times 10^{-4}$) | 0.04 | 75 | 0.07 | 70 |
| 209 | I-3 ($1.4 \times 10^{-4}$) | II-11 ($1.4 \times 10^{-4}$) | III-2 ($1.4 \times 10^{-4}$) | 0.04 | 125 | 0.06 | 120 |
| 210 | I-3 ($1.4 \times 10^{-4}$) | II-11 ($1.4 \times 10^{-4}$) | III-5 ($1.4 \times 10^{-4}$) | 0.04 | 140 | 0.06 | 135 |
| 211 | I-3 ($1.4 \times 10^{-4}$) | II-12 ($1.4 \times 10^{-4}$) | III-2 ($1.4 \times 10^{-4}$) | 0.04 | 135 | 0.07 | 125 |
| 212 (comparison) | I-3 ($2.4 \times 10^{-4}$) | II-3 ($1.8 \times 10^{-4}$) | — | 0.04 | 100 | 0.10 | 88 |
| 213 (comparison) | I-15 ($1.8 \times 10^{-4}$) | II-1 ($2.4 \times 10^{-4}$) | — | 0.03 | 110 | 0.07 | 90 |
| 214 | I-3 ($1.6 \times 10^{-4}$) | II-3 ($1.2 \times 10^{-4}$) | III-9 ($1.4 \times 10^{-4}$) | 0.03 | 140 | 0.05 | 132 |
| 215 | I-3 ($1.6 \times 10^{-4}$) | II-3 ($1.2 \times 10^{-4}$) | III-10 ($1.4 \times 10^{-4}$) | 0.04 | 147 | 0.05 | 138 |
| 216 | I-15 ($1.2 \times 10^{-4}$) | II-1 ($1.6 \times 10^{-4}$) | III-13 ($1.4 \times 10^{-4}$) | 0.04 | 135 | 0.06 | 128 |
| 217 | I-15 ($1.2 \times 10^{-4}$) | II-1 ($1.6 \times 10^{-4}$) | III-14 ($1.4 \times 10^{-4}$) | 0.04 | 141 | 0.05 | 134 |
| 218 (comparison) | I-24 ($2.1 \times 10^{-4}$) | II-7 ($2.1 \times 10^{-4}$) | — | 0.03 | 100 | 0.09 | 85 |
| 219 (comparison) | I-24 ($1.4 \times 10^{-4}$) | II-7 ($1.4 \times 10^{-4}$) | Comparative dye D-1 ($1.4 \times 10^{-4}$) | 0.03 | 110 | 0.09 | 85 |
| 220 | I-24 ($1.4 \times 10^{-4}$) | II-7 ($1.4 \times 10^{-4}$) | III-29 ($1.4 \times 10^{-4}$) | 0.02 | 155 | 0.10 | 150 |
| 221 | I-24 ($1.4 \times 10^{-4}$) | II-7 ($1.4 \times 10^{-4}$) | III-30 ($1.4 \times 10^{-4}$) | 0.03 | 165 | 0.08 | 155 |
| 222 | I-24 ($1.4 \times 10^{-4}$) | II-7 ($1.4 \times 10^{-4}$) | III-35 ($1.4 \times 10^{-4}$) | 0.03 | 160 | 0.08 | 155 |
| 223 (comparison) | I-24 ($2.1 \times 10^{-4}$) | II-14 ($2.1 \times 10^{-4}$) | — | 0.04 | 100 | 0.08 | 85 |
| 224 (comparison) | — | II-14 ($2.1 \times 10^{-4}$) | III-31 ($2.1 \times 10^{-4}$) | 0.04 | 95 | 0.07 | 80 |
| 225 | I-24 | — | III-31 | 0.04 | 100 | 0.07 | 85 |

TABLE 3-continued

| Sample No. | Spectral sensitizer and its amount (mol/mol AgX) Formula (I) | Formula (II) | Formula (III) | As fresh fog | sensitivity | After standing for 3 days at 50° C. × 80% r.h. fog | sensitivity |
|---|---|---|---|---|---|---|---|
| (comparison) | ($2.1 \times 10^{-4}$) | | ($2.1 \times 10^{-4}$) | | | | |
| 226 | I-24 ($1.4 \times 10^{-4}$) | II-14 ($1.4 \times 10^{-4}$) | III-31 ($1.4 \times 10^{-4}$) | 0.04 | 170 | 0.06 | 165 |
| 227 | I-24 ($1.4 \times 10^{-4}$) | II-14 ($1.4 \times 10^{-4}$) | III-32 ($1.4 \times 10^{-4}$) | 0.04 | 165 | 0.06 | 165 |
| 228 | I-24 ($1.4 \times 10^{-4}$) | II-14 ($1.4 \times 10^{-4}$) | III-34 ($1.4 \times 10^{-4}$) | 0.04 | 165 | 0.07 | 160 |
| 229 (comparison) | I-30 ($2.1 \times 10^{-4}$) | II-23 ($2.1 \times 10^{-4}$) | — | 0.03 | 100 | 0.09 | 75 |
| 230 (comparison) | I-30 ($1.4 \times 10^{-4}$) | II-23 ($1.4 \times 10^{-4}$) | Comparative dye D-2 ($1.4 \times 10^{-4}$) | 0.03 | 95 | 0.08 | 70 |
| 231 | I-30 ($1.4 \times 10^{-4}$) | II-23 ($1.4 \times 10^{-4}$) | III-40 ($1.4 \times 10^{-4}$) | 0.02 | 150 | 0.06 | 140 |
| 232 | I-30 ($1.4 \times 10^{-4}$) | II-23 ($1.4 \times 10^{-4}$) | III-43 ($1.4 \times 10^{-4}$) | 0.03 | 165 | 0.06 | 145 |
| 233 | I-33 ($1.4 \times 10^{-4}$) | II-23 ($1.4 \times 10^{-4}$) | III-48 ($1.4 \times 10^{-4}$) | 0.03 | 160 | 0.07 | 145 |
| 234 (comparison) | I-32 ($2.1 \times 10^{-4}$) | II-20 ($2.1 \times 10^{-4}$) | — | 0.04 | 100 | 0.08 | 70 |
| 235 (comparison) | — | II-20 ($2.1 \times 10^{-4}$) | III-44 ($2.1 \times 10^{-4}$) | 0.04 | 90 | 0.07 | 60 |
| 236 (comparison) | I-32 ($2.1 \times 10^{-4}$) | — | III-44 ($2.1 \times 10^{-4}$) | 0.04 | 100 | 0.07 | 70 |
| 237 | I-32 ($1.4 \times 10^{-4}$) | II-20 ($1.4 \times 10^{-4}$) | III-44 ($1.4 \times 10^{-4}$) | 0.04 | 150 | 0.06 | 140 |
| 238 | I-32 ($1.4 \times 10^{-4}$) | II-20 ($1.4 \times 10^{-4}$) | III-49 ($1.4 \times 10^{-4}$) | 0.04 | 140 | 0.06 | 135 |
| 239 | I-31 ($1.4 \times 10^{-4}$) | II-20 ($1.4 \times 10^{-4}$) | III-51 ($1.4 \times 10^{-4}$) | 0.04 | 150 | 0.07 | 150 |

EXAMPLE 4

Using a subbed cellulose acetate base support, sample Nos. 301–333 of multi-layered color photographic material having the composition shown in the following table were prepared.

| Layer | Main components | Amount used |
|---|---|---|
| First layer (HC) (anti-halation layer) | black coloidal silver | 0.20 |
| | gelatin | 1.5 |
| | u.v. absorber UV-1 | 0.1 |
| | u.v. absorber UV-2 | 0.2 |
| | dioctyl phthalate (DOP) | 0.03 |
| Second layer (R-1) (first red-sensitive emulsion layer) | Em No. 1 | 1.2 |
| | gelatin | 1.1 |
| | spectral sensitizer I | $6 \times 10^{-5}$ |
| | spectral sensitizer II | $1 \times 10^{-5}$ |
| | coupler (C-1) | 0.08 |
| | coupler (CC-1) | 0.005 |
| | coupler (D-1) | 0.003 |
| | coupler (D-2) | 0.004 |
| | DOP | 0.6 |
| Third layer (IL-2) (intermediate layer) | gelatin | 0.8 |
| | AS-1 | 0.03 |
| | DOP | 0.1 |
| Fourth layer (G-1) (first green-sensitive emulsion layer) | Em No. 1 | 1.1 |
| | gelatin | 1.2 |
| | spectral sensitizer (see Table 4) | |
| | coupler (M-2) | 0.045 |
| | coupler (CM-1) | 0.009 |
| | coupler (D-1) | 0.001 |
| | coupler (D-3) | 0.003 |
| | tricresyl phosphate (TCP) | 0.05 |
| Fifth layer (YC) (yellow filter layer) | gelatin | 0.6 |
| | yellow colloidal silver | 0.08 |
| | AS-1 | 0.1 |
| | DOP | 0.3 |
| Sixth layer (B-1) (first blue-sensitive emulsion layer) | Em No. 1 | 0.5 |
| | gelatin | 1.1 |
| | spectral sensitizer III | $1.3 \times 10^{-5}$ |
| | coupler (Y-1) | 0.29 |
| | TCP | 0.2 |
| Seventh layer (Pro-1) (first protective layer) | gelatin | 0.55 |
| | u.v. absorber UV-1 | 0.1 |
| | u.v. absorber UV-2 | 0.2 |
| | DOP | 0.03 |
| | AgIBr (1 mol % AgI; average grain size, 0.07 μm) | 0.5 |
| Eighth layer (Pro-2) (second protective layer) | gelatin | 0.5 |
| | polymethyl methacrylate particles (dia. 1.5 μm) | 0.2 |
| | formaldehyde scavenger (HS-1) | 3.0 |
| | hardener (H-1) | 0.4 |

Each of the layers 1–8 contained a surfactant as a coating aid in addition to the components described above. The additives used were the same as those employed in Example 1.

Additional Samples (Nos. 334–344) were prepared; they were the same as sample Nos. 301–333 except that spectral sensitizers I and II in the second layer were replaced by those shown in Table 4 and that spectral sensitizer IV (see above) was used in the fourth layer.

The figures under "Amount used" in the above table refer to grams of silver per square meter for silver halide and coloidal silver and grams per square meter for additives and gelatin. The figures given in connection with couplers refer to moles per mole of silver halide in the same layer.

The samples prepared were processed and their performance evaluated as in Example 2. The results are shown in Table 4.

TABLE 4

| Sample No. | Em No. | Spectral sensitizer and its amount (mol/mol AgX) Formula (I) | Formula (II) | Formula (III) | As fresh fog | As fresh sensitivity | After standing for 3 days at 50° C. × 80% r.h. fog | After standing for 3 days at 50° C. × 80% r.h. sensitivity |
|---|---|---|---|---|---|---|---|---|
| 301 (comparison) | 1 | I-2 ($2.1 \times 10^{-4}$) | II-1 ($2.1 \times 10^{-4}$) | — | 0.16 | 100 | — | 50 |
| 302 (comparison) | 1 | I-2 ($1.4 \times 10^{-4}$) | II-1 ($1.4 \times 10^{-4}$) | Comparative dye D-1 ($1.4 \times 10^{-4}$) | 0.16 | 110 | — | 60 |
| 303 | 1 | I-2 ($1.4 \times 10^{-4}$) | II-2 ($1.4 \times 10^{-4}$) | III-1 ($1.4 \times 10^{-4}$) | 0.16 | 205 | — | 190 |
| 304 | 1 | I-2 ($1.4 \times 10^{-4}$) | II-1 ($1.4 \times 10^{-4}$) | III-1 ($1.4 \times 10^{-4}$) | 0.16 | 200 | — | 180 |
| 305 | 1 | I-2 ($1.4 \times 10^{-4}$) | II-1 ($1.4 \times 10^{-4}$) | III-4 ($1.4 \times 10^{-4}$) | 0.16 | 205 | — | 185 |
| 306 (comparison) | 1 | I-3 ($2.1 \times 10^{-4}$) | II-11 ($2.1 \times 10^{-4}$) | — | 0.15 | 100 | — | 40 |
| 307 (comparison) | 1 | — | II-11 ($1.4 \times 10^{-4}$) | III-2 ($2.1 \times 10^{-4}$) | 0.15 | 90 | — | 45 |
| 308 (comparison) | 1 | I-3 ($1.4 \times 10^{-4}$) | — | III-5 ($2.1 \times 10^{-4}$) | 0.15 | 110 | — | 45 |
| 309 | 1 | I-3 ($1.4 \times 10^{-4}$) | II-11 ($1.4 \times 10^{-4}$) | III-2 ($1.4 \times 10^{-4}$) | 0.15 | 220 | — | 195 |
| 310 | 1 | I-3 ($1.4 \times 10^{-4}$) | II-11 ($1.4 \times 10^{-4}$) | III-5 ($1.4 \times 10^{-4}$) | 0.15 | 230 | — | 205 |
| 311 | 1 | I-3 ($1.4 \times 10^{-4}$) | II-12 ($1.4 \times 10^{-4}$) | III-2 ($1.4 \times 10^{-4}$) | 0.15 | 205 | — | 195 |
| 312 (comparison) | 1 | I-3 ($2.4 \times 10^{-4}$) | II-3 ($1.8 \times 10^{-4}$) | — | 0.18 | 100 | — | 35 |
| 313 (comparison) | 1 | I-15 ($1.8 \times 10^{-4}$) | II-1 ($2.4 \times 10^{-4}$) | — | 0.18 | 110 | — | 35 |
| 314 | 1 | I-3 ($1.6 \times 10^{-4}$) | II-3 ($1.2 \times 10^{-4}$) | III-10 ($1.4 \times 10^{-4}$) | 0.20 | 220 | — | 195 |
| 315 | | I-3 ($1.6 \times 10^{-4}$) | II-3 ($1.2 \times 10^{-4}$) | III-9 ($1.4 \times 10^{-4}$) | 0.20 | 205 | — | 190 |
| 316 | 1 | I-15 ($1.2 \times 10^{-4}$) | II-1 ($1.6 \times 10^{-4}$) | III-13 ($1.4 \times 10^{-4}$) | 0.19 | 205 | — | 200 |
| 317 | 1 | I-15 ($1.2 \times 10^{-4}$) | II-1 ($1.6 \times 10^{-4}$) | III-14 ($1.4 \times 10^{-4}$) | 0.19 | 195 | — | 185 |
| 318 (comparison) | 1 | I-2 ($2.1 \times 10^{-4}$) | II-12 ($2.1 \times 10^{-4}$) | — | 0.17 | 100 | — | 40 |
| 319 (comparison) | 1 | I-2 ($1.4 \times 10^{-4}$) | II-12 ($1.4 \times 10^{-4}$) | Comparative dye D-1 ($1.4 \times 10^{-4}$) | 0.18 | 95 | — | 35 |
| 320 | 1 | I-2 ($1.4 \times 10^{-4}$) | II-12 ($1.4 \times 10^{-4}$) | III-26 ($1.4 \times 10^{-4}$) | 0.16 | 195 | — | 150 |
| 321 | 1 | I-2 ($1.4 \times 10^{-4}$) | II-12 ($1.4 \times 10^{-4}$) | III-26 ($2.0 \times 10^{-4}$) | 0.15 | 190 | — | 190 |
| 322 | 1 | I-2 ($1.4 \times 10^{-4}$) | II-12 ($1.4 \times 10^{-4}$) | III-27 ($1.4 \times 10^{-4}$) | 0.16 | 120 | — | 55 |
| 323 (comparison) | 1 | I-23 ($2.1 \times 10^{-4}$) | II-7 ($2.1 \times 10^{-4}$) | — | 0.16 | 100 | 0.30 | 55 |
| 324 (comparison) | 1 | I-23 ($1.4 \times 10^{-4}$) | II-7 ($1.4 \times 10^{-4}$) | Comparative dye D-1 ($1.4 \times 10^{-4}$) | 0.16 | 100 | 0.29 | 60 |
| 325 | 1 | I-23 ($1.4 \times 10^{-4}$) | II-7 ($1.4 \times 10^{-4}$) | III-29 ($1.4 \times 10^{-4}$) | 0.16 | 220 | 0.22 | 210 |
| 326 | 1 | I-23 ($1.4 \times 10^{-4}$) | II-7 ($1.4 \times 10^{-4}$) | III-30 ($1.4 \times 10^{-4}$) | 0.16 | 205 | 0.20 | 195 |
| 327 | 1 | I-23 ($1.4 \times 10^{-4}$) | II-7 ($1.4 \times 10^{-4}$) | III-35 ($1.4 \times 10^{-4}$) | 0.16 | 210 | 0.21 | 200 |
| 328 (comparison) | 1 | I-24 ($2.1 \times 10^{-4}$) | II-17 ($2.1 \times 10^{-4}$) | — | 0.15 | 100 | 0.31 | 60 |
| 329 (comparison) | 1 | — | II-17 ($1.4 \times 10^{-4}$) | III-31 ($2.1 \times 10^{-4}$) | 0.15 | 105 | 0.30 | 60 |
| 330 (comparison) | 1 | I-24 ($1.4 \times 10^{-4}$) | — | III-31 ($2.1 \times 10^{-4}$) | 0.15 | 95 | 0.30 | 55 |
| 331 | 1 | I-24 ($1.4 \times 10^{-4}$) | II-17 ($1.4 \times 10^{-4}$) | III-31 ($1.4 \times 10^{-4}$) | 0.15 | 190 | 0.24 | 190 |
| 332 | 1 | I-24 ($1.4 \times 10^{-4}$) | II-17 ($1.4 \times 10^{-4}$) | III-32 ($1.4 \times 10^{-4}$) | 0.15 | 185 | 0.23 | 180 |
| 333 | 1 | I-24 ($1.4 \times 10^{-4}$) | II-17 ($1.4 \times 10^{-4}$) | III-34 ($1.4 \times 10^{-4}$) | 0.15 | 185 | 0.24 | 185 |
| 334 (comparison) | 1 | I-42 ($2.1 \times 10^{-4}$) | II-22 ($2.1 \times 10^{-4}$) | — | 0.16 | 100 | 0.31 | 40 |
| 335 (comparison) | 1 | I-42 ($1.4 \times 10^{-4}$) | II-22 ($1.4 \times 10^{-4}$) | Comparative dye D-2 ($1.4 \times 10^{-4}$) | 0.16 | 100 | 0.31 | 45 |
| 336 | 1 | I-42 ($1.4 \times 10^{-4}$) | II-22 ($1.4 \times 10^{-4}$) | III-39 ($1.4 \times 10^{-4}$) | 0.16 | 205 | 0.25 | 200 |
| 337 | 1 | I-42 ($1.4 \times 10^{-4}$) | II-22 ($1.4 \times 10^{-4}$) | III-46 ($1.4 \times 10^{-4}$) | 0.16 | 200 | 0.24 | 190 |

TABLE 4-continued

| Sample No. | Em No. | Spectral sensitizer and its amount (mol/mol AgX) Formula (I) | Formula (II) | Formula (III) | As fresh fog | As fresh sensitivity | After standing for 3 days at 50° C. × 80% r.h. fog | After standing for 3 days at 50° C. × 80% r.h. sensitivity |
|---|---|---|---|---|---|---|---|---|
| 338 | 1 | I-34 ($1.4 \times 10^{-4}$) | II-22 ($1.4 \times 10^{-4}$) | III-47 ($1.4 \times 10^{-4}$) | 0.16 | 210 | 0.24 | 205 |
| 339 (comparison) | 1 | I-32 ($2.1 \times 10^{-4}$) | II-20 ($2.1 \times 10^{-4}$) | — | 0.15 | 100 | 0.30 | 45 |
| 340 (comparison) | 1 | — | II-20 ($1.4 \times 10^{-4}$) | III-44 ($2.1 \times 10^{-4}$) | 0.15 | 95 | 0.30 | 45 |
| 341 (comparison) | 1 | I-32 ($1.4 \times 10^{-4}$) | — | III-44 ($2.1 \times 10^{-4}$) | 0.15 | 95 | 0.30 | 40 |
| 342 | 1 | I-32 ($1.4 \times 10^{-4}$) | II-20 ($1.4 \times 10^{-4}$) | III-44 ($1.4 \times 10^{-4}$) | 0.15 | 190 | 0.23 | 190 |
| 343 | 1 | I-32 ($1.4 \times 10^{-4}$) | II-23 ($1.4 \times 10^{-4}$) | III-40 ($1.4 \times 10^{-4}$) | 0.15 | 185 | 0.25 | 180 |
| 344 | 1 | I-35 ($1.4 \times 10^{-4}$) | II-20 ($1.4 \times 10^{-4}$) | III-51 ($1.4 \times 10^{-4}$) | 0.15 | 190 | 0.25 | 185 |

As is clear from the data shown in Table 4, the problem of desensitization which occurred on account of desorption of spectral sensitizers in photographic materials of a multi-layered structure could successfully be solved by using two symmetrical dyes in combination with one asymmetrical dye having partial structures common to one of those in the symmetrical dyes. While such combination of dyes was also effective in preventing the occurrence of desensitization due to desorption of spectral sensitizers in single-layered photographic materials, its effectiveness was greater in multilayered structures.

Thus, according to the present invention, desensitization due to desorption of spectral sensitizers from silver halides is successfully prevented to insure the production of a silver halide photographic material having high sensitivity and good storage stability.

What is claimed is:

1. A silver halide photographic material in which at least one silver halide emulsion layer coated onto a base support has been subjected to supersensitization by the combination of at least one symmetrical carbocyanine dye having two symmetrical heterocyclic structures as represented by the following general formula (I), at least one symmetrical carbocyanine dye also having two symmetrical heterocyclic structures as represented by the following general formula (II), and at least one asymmetrical carbocyanine dye represented by the following general formula (III) which has either one of the two heterocyclic structures shown in the general formula (I) and either one of the two heterocyclic structures shown in the general formula (II):

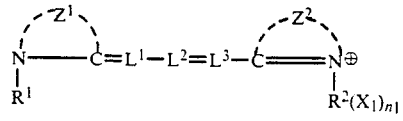

(I)

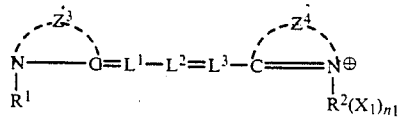

(II)

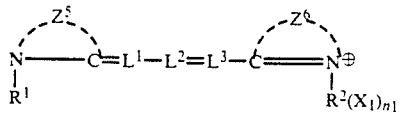

(III)

where $Z^1$ and $Z^2$ each represents the nonmetallic atomic group necessary to form the same benzoxazole ring nucleus, benzimidazole ring nucleus, naptho[2,3-α]oxazole ring nucleus or benzothiazole ring nucleus; $Z^3$ and $Z^4$ each represents the nonmetallic atomic group necessary to form the same napthoxazole ring nucleus, napthoimidazole ring nucleus or napthoimidazole ring nucleus when $Z^1$ and $Z^2$ each represents the nonmetallic atomic group necessary to form the same benzoxazole ring nucleus, benzimidazole ring nucleus or benzothiazole ring nucleus, and $Z^3$ and $Z^4$ each represents the nonmetallic atomic group necessary to form the same naptho[1,2-α]oxazole ring nucleus or naptho[2,1-α]oxazole ring nucleus when $Z^1$ and $Z^2$ each represents the nonmetallic atomic group necessary to form the same naptho[2,3-α]oxazole ring nucleus; $Z^5$ is the same as $Z^1$ or $Z^2$ or it represents $Z^1$ or $Z^2$ having a substituent defined by a sterimol parameter ($L/B_1$) of not greater than 2.2 $Z^6$ is the same as $Z^3$ or $Z^4$ or represents $Z^3$ or $Z^4$ having a substituent defined by a sterimol parameter ($L/B_1$) of not greater than 2.2; $R^1$ and $R^2$ which may be the same or different each represents an alkyl or a substituted alkyl group; $L^1$, $L^2$ and $L^3$ each represents a methine or a substituted methine group; $X_1$ is a counter ion residue; and $n_1$ is 0 or 1.

2. A silver halide photographic material according to claim 1 wherein $Z^1$ and $Z^2$ each represents the nonmetallic atomic group necessary to form the same benzoxazole ring nucleus or benzimidazole ring nucleus, and $Z^3$ and $Z^4$ each represents the nonmetallic atomic group necessary to form the same naphthoxazole ring nucleus or naphthoimidazole ring nucleus.

3. A silver halide photographic material according to claim 2 wherein the symmetrical carbocyanine dye represented by the general formula (I) is a symmetrical oxacarbocyanine dye represented by the following general formula (I-I):

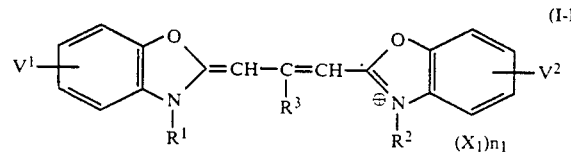

(I-I)

where $V^1$ and $V^2$ each represents a hydrogen atom, a halogen atom, an alkyl group having up to 6 carbon atoms, an aryl group, an alkoxy group having up to 4 carbon atoms, an aryloxy group, an acyl group having up to 6 carbon atoms, an alkoxycarbonyl group having up to 8 carbon atoms, a hydroxy group, a cyano group or a trifluoromethyl group; $R^3$ represents an alkyl group having up to 2 carbon atoms; and $R^1$, $R^2$ and $(X_1)_{n1}$ each has the same meaning as defined in the general formula (I).

4. A silver halide photographic material according to claim 2 wherein the symmetrical carbocyanine dye represented by the general formula (I) is a symmetrical benzimidazolocarbocyanine dye represented by the following general formula (I-II):

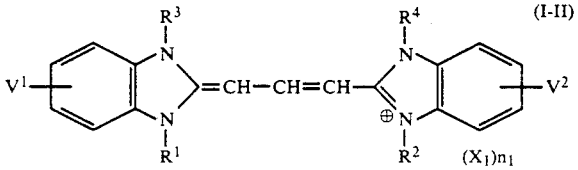

(I-II)

where $V^1$ and $V^2$ each represents a hydrogen atom, a halogen atom, an alkyl group having up to 6 carbon atoms, an aryl group, an alkoxy group having up to 4 carbon atoms, an aryloxy group, an acyl group having up to 6 carbon atoms, an acyloxy group having up to 3 carbon atoms, an alkoxycarbonyl group having up to 8 carbon atoms, a carbamoyl group having up to 8 carbon atoms, a sulfamoyl group having up to 8 carbon atoms, a hydroxy group, a cyano group or a trifluoromethyl group; $R^3$ and $R^4$ represents independently a substituted or unsubstituted alkyl group or an aryl group; and $R^1$, $R^2$ and $(X_1)_{n1}$ each has the same meaning as defined in the general formula (I).

5. A silver halide photographic material according to claim 2 wherein the symmetrical carbocyanine dye represented by the general formula (II) is a symmetrical naphthoxacarbocyanine or naphthoimidazolocarbocyanine dye having naphtho rings condensed together as hetero rings.

6. A silver halide photographic material according to claim 2 wherein the asymmetrical carbocyanine dye represented by the general formula (III) is an asymmetrical oxacarbocyanine, benzimidazolocarbocyanine or oxaimidazolocarbocyanine dye.

7. A silver halide photographic material according to claim (2) wherein $Z^1$ and $Z^2$ each represents the nonmetallic atomic group necessary to form the same benzoxaole ring nucleus and $Z^3$ and $Z^4$ each represents the nonmetallic atomic group necessary to form the same naphthoxazole ring nucleus.

8. A silver halide photographic material according to claim 1 wherein $Z^1$ and $Z^2$ each represents the nonmetallic atomic group necessary to form the same naphtho[2,3-d]oxazole ring nucleus, and $Z^3$ and $Z^4$ each represents the nonmetallic atomic group necessary to form the same naphtho[1,2-α]oxazole ring nucleus or naphtho[2,1-d]oxazole ring nucleus.

9. A silver halide photographic material according to claim 8 wherein the symmetrical carbocyanine dye represented by the general formula (I) is a symmetrical oxacarbocyanine dye represented by the following general formula (I-III):

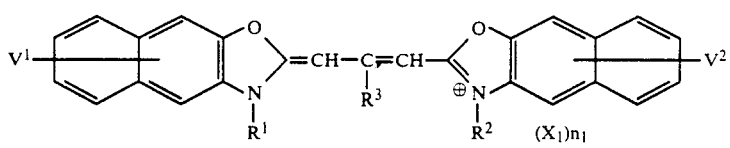

(I-III)

where $V^1$ and $V^2$ each represents a hydrogen atom, a halogen atom, an alkyl group having up to 6 carbon atoms, an aryl group, an alkoxy group having up to 4 carbon atoms, an aryloxy group, an acyl group having up to 7 carbon atoms, an alkoxycarbonyl group having up to 8 carbon atoms, a hydroxy group, a cyano group or a trifluoromethyl group; $R^3$ represents an alkyl group having up to 2 carbon atoms, and $R^1$, $R^2$ and $(X_1)_{n1}$ each has the same meaning as defined in the general formula (I).

10. A silver halide photographic material according to claim 8 wherein the symmetrical carbocyanine dye represented by the general formula (II) is a symmetrical oxacarbocyanine dye having the naphtho[1,2-d]oxazole ring nucleus or naphtho[2,1-d]oxazole ring nucleus as a hetero ring.

11. A silver halide photographic material according to claim 8 wherein the asymmetrical carbocyanine dye represented by the general formula (III) is an asymmetrical oxacarbocyanine dye.

12. A silver halide photographic material according to claim 1 where $Z^1$ and $Z^2$ each represents the nonmetallic atomic group necessary to form the same benzothiazole ring nucleus, and $Z^3$ and $Z^4$ each represents the nonmetallic atomic group necessary to form the same naphthothiazole ring nucleus.

13. A silver halide photographic material according to claim 12 wherein the symmetrical carbocyanine dye represented by the general formula (I) is a symmetrical thiacarbocyanine dye represented by the following general formula (I-IV):

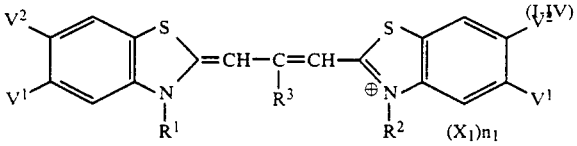

(I-IV)

where $V^1$ and $V^2$ each represents a hydrogen atom, a halogen atom, an alkyl group having up to 6 carbon atoms, an aryl group, an alkoxy group having up to 4 carbon atoms, an aryloxy group, an acyl group having up to 7 carbon atoms, an alkoxycarbonyl group having up to 8 carbon atoms, a hydroxy group, a cyano group or a trifluoromethyl group; $R^3$ represents an alkyl group having up to 2 carbon atoms, and $R^1$, $R^2$ and $(X_1)_{n1}$ each has the same meaning as defined in the general formula (I).

14. A silver halide photographic material according to claim 12 wherein the symmetrical carbocyanine dye represented by the general formula (II) is a symmetrical naphtho[1,2-α]thiacarbocyanine, naphtho[2,1-α]thiacarbocyanine or naphtho[2,3-α]thiacarbocyanine having naphtho rings condensed together as hetero rings.

15. A silver halide photographic material according to claim 12 wherein the asymmetrical carbocyanine dye represented by the general formula (III) is an asymmetrical thiacarbocyanine dye.

16. A silver halide photographic material according to claim 1 wherein the dyes represented by the general formulas (I), (II) and (III) are added in a total amount ranging from $1\times10^{-6}$ to $5\times10^{-3}$ moles per mole of silver halide.

17. A silver halide photographic material according to claim 1 wherein the dyes represented by the general formulas (I), (II) and (III) are added in such amounts that the ratio of (I) to (III) ranges from 0.05 to 20 and the ratio of (II) to (III) also ranges from 0.05 to 20.

18. A silver halide photographic material according to claim 1 wherein said at least one silver halide emulsion layer comprises a silver iodobromide emulsion.

19. A silver halide photographic material according to claim 18 wherein said silver iodobromide emulsion comprises grains which contain an internal localized region in which silver iodide is present at a high concentration of at least 20 mol %.

* * * * *

UNITED STATES PATENT AND TRADEMARK OFFICE

CERTIFICATE OF CORRECTION

PATENT NO. : 5,041,366

DATED : August 20, 1992

INVENTOR(S) : Satomi Asano, et al

It is certified that error appears in the above-indentified patent and that said Letters Patent is hereby corrected as shown below:

Claim 1, column 60, lines 21 and 22, "naptho[2,3-α]oxazole" should read --naphtho[2,3-α]oxazole--;

line 24, "napthoxazole" should read --naphthoxazole--;

lines 24 and 25, "napthoimidazole" should read --naphthoimidazole--;

line 25, change "napthoimidazole" to --naphthoimidazole--;

line 37, after "2.2" insert --;--.

Claim 7, column 61, line 54, "(2)" should read --2--; and lines 55 and 56, "benzoxaole" should read --benzoxazole--.

Signed and Sealed this

Seventh Day of September, 1993

Bruce Lehman

*Attest:*

BRUCE LEHMAN

*Attesting Officer*

*Commissioner of Patents and Trademarks*